US011634982B2

(12) United States Patent
Zhang et al.

(10) Patent No.: US 11,634,982 B2
(45) Date of Patent: Apr. 25, 2023

(54) FILTERING OF RSS PAD NOISE IN MUD PULSE TELEMETRY SYSTEMS AND DETECTION OF RSS PAD LEAKS

(71) Applicant: Halliburton Energy Services, Inc., Houston, TX (US)

(72) Inventors: Lizheng Zhang, Houston, TX (US); Paravastu Badrinarayanan, Houston, TX (US); Malay Mehta, Houston, TX (US); Rashobh Rajan Sobhana, Houston, TX (US); Felipe Costa Oliveira Chagas, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/209,859

(22) Filed: Mar. 23, 2021

(65) Prior Publication Data

US 2022/0235650 A1 Jul. 28, 2022

Related U.S. Application Data

(60) Provisional application No. 63/140,294, filed on Jan. 22, 2021.

(51) Int. Cl.

| | |
|---|---|
| ***E21B 47/18*** | (2012.01) |
| ***E21B 47/117*** | (2012.01) |
| ***E21B 7/04*** | (2006.01) |

(52) U.S. Cl.

CPC ..... *E21B 47/117* (2020.05); *E21B 7/04* (2013.01); *E21B 47/18* (2013.01)

(58) Field of Classification Search

CPC ..... E21B 47/117; E21B 7/04; E21B 47/18

See application file for complete search history.

(56) References Cited

U.S. PATENT DOCUMENTS

| | | | | |
|---|---|---|---|---|
| 5,146,433 | A | 9/1992 | Kosmala et al. | |
| 7,324,010 | B2 | 1/2008 | Gardner et al. | |
| 9,249,793 | B2 | 2/2016 | Brackel | |
| 2004/0155794 | A1 | 8/2004 | Gardner | |
| 2007/0192031 | A1 | 8/2007 | Li et al. | |
| 2008/0074948 | A1 | 3/2008 | Reckmann | |
| 2010/0314169 | A1 | 12/2010 | Jarrot et al. | |
| 2015/0218937 | A1 | 8/2015 | Conn et al. | |
| 2018/0298749 | A1 * | 10/2018 | Barak | E21B 21/08 |
| 2019/0304106 | A1 * | 10/2019 | Lemarenko | G06T 7/30 |
| 2019/0338628 | A1 | 11/2019 | Sehsah et al. | |
| 2021/0148222 | A1 * | 5/2021 | Dwyer | H04B 1/1027 |
| 2022/0010625 | A1 * | 1/2022 | Williams | E21B 44/06 |

FOREIGN PATENT DOCUMENTS

| | | | |
|---|---|---|---|
| EP | 3054085 B1 | 8/2018 | |
| GB | 2392762 A | 3/2004 | |
| WO | WO 2016/093819 A1 | 6/2016 | |
| WO | WO-2020102310 A1 * | 5/2020 | E21B 21/08 |

OTHER PUBLICATIONS

Search Report and Written Opinion issued for International Patent Application No. PCT/US2021/023809, dated Dec. 7, 2021, 13 pages.

* cited by examiner

*Primary Examiner* — Taras P Bemko

(74) *Attorney, Agent, or Firm* — Novak Druce Carroll LLP

(57) ABSTRACT

Systems and methods for adaptive filtering of RSS pad noise and the detection of RSS pad seal leakage in real-time.

14 Claims, 19 Drawing Sheets

FILTERING OF RSS PAD NOISE IN MUD PULSE TELEMETRY SYSTEMS AND DETECTION OF RSS PAD LEAKS

PRIORITY

The present application is a Non-Provisional patent application of U.S. Provisional patent application No. 63/140,294, filed on Jan. 22, 2021, the benefit of which is claimed and the disclosure of which is incorporated herein by reference in its entirety.

FIELD OF THE DISCLOSURE

The present disclosure relates generally to downhole telemetry and, more specifically, to a method and system to filter rotary steerable system pad noise and detect pad leaks using mud pulse telemetry systems.

BACKGROUND

In the field of oil and gas exploration and extraction, pressure sensors are customarily used at the surface for reading data provided by acoustic transducers downhole. The data travels through the drilling mud along the wellbore, typically in the form of short pulses providing a binary encoded signal. One of the most severe interference sources for mud pulse telemetry is the perturbation generated by the pumps that circulate the mud. Many techniques have been developed to reduce or eliminate pump interference.

Another severe interference source is caused by the pads of a rotary steerable system. A rotary steerable system ("RSS") is a form of drilling technology used in directional drilling. Push-the-bit type RSS tools use pads on the outside of the tool which press against the well bore thereby causing the bit to press on the opposite side causing a direction change. Actuation of the RSS pads, the pad piston, leakage in the pad/face seals, or reciprocation of the pad piston will create bore pressure disturbances. These disturbances will create a negative pulse or positive pulse (water hammer effect) to the bore pressure. These pulses will propagate through the wellbore and to the surface, where they become noise in the mud pulse telemetry detection unit.

The RSS pad noise severely affects mud pulse detection quality. In some instances, the RSS pad noise results in zero detection of telemetry signals at the detection unit. Conventional approaches have failed to provide any technique to address RSS pad noise in mud pulse telemetry systems.

Furthermore, the elastomeric pad/face seals or other components of the RSS degrade over time and eventually fail, causing loss of steerability and erosion of expensive parts. Conventional methods have failed to provide any method by which to detect RSS leaks in real time.

DESCRIPTION OF ILLUSTRATIVE EMBODIMENTS

Illustrative embodiments and related methods of the present disclosure are described below as they might be employed in a mud pulse telemetry system and method to filter RSS pad noise and detect RSS leaks. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As will be described below, the present disclosure provides adaptive filtering methods to filter out noise caused by the RSS pads, thus improving telemetry unit detection quality. Other methods described herein are used to detect RSS pad leakage in real-time to allow for prompt actions to address/prevent damages caused by leaky seals or other faulty components.

In a generalized method of the present disclosure, a first data carrying signal is generated using a downhole pulser or some other telemetry unit that generates data carrying signals. During operation, RSS pads generate noise signals that combine with the first data-carrying signal to form a second data-carrying signal. A controller detects the second data-carrying signal and applies an adaptive filter in order to filter the RSS pad noise. As a result, a third data-carrying signal having a reduced or eliminated RSS pad noise content is output, decoded and used to perform a wellbore operation.

In another generalized method of the present disclosure, an RSS signal is generated by the RSS. This signal can be generated in a variety of ways, such as by actuation of an RSS pad. The RSS signal is then detected at the controller where the frequency spectrum of the RSS pad signal is analyzed. Based upon this frequency spectrum analysis, an RSS leak is identified.

Figure 1:
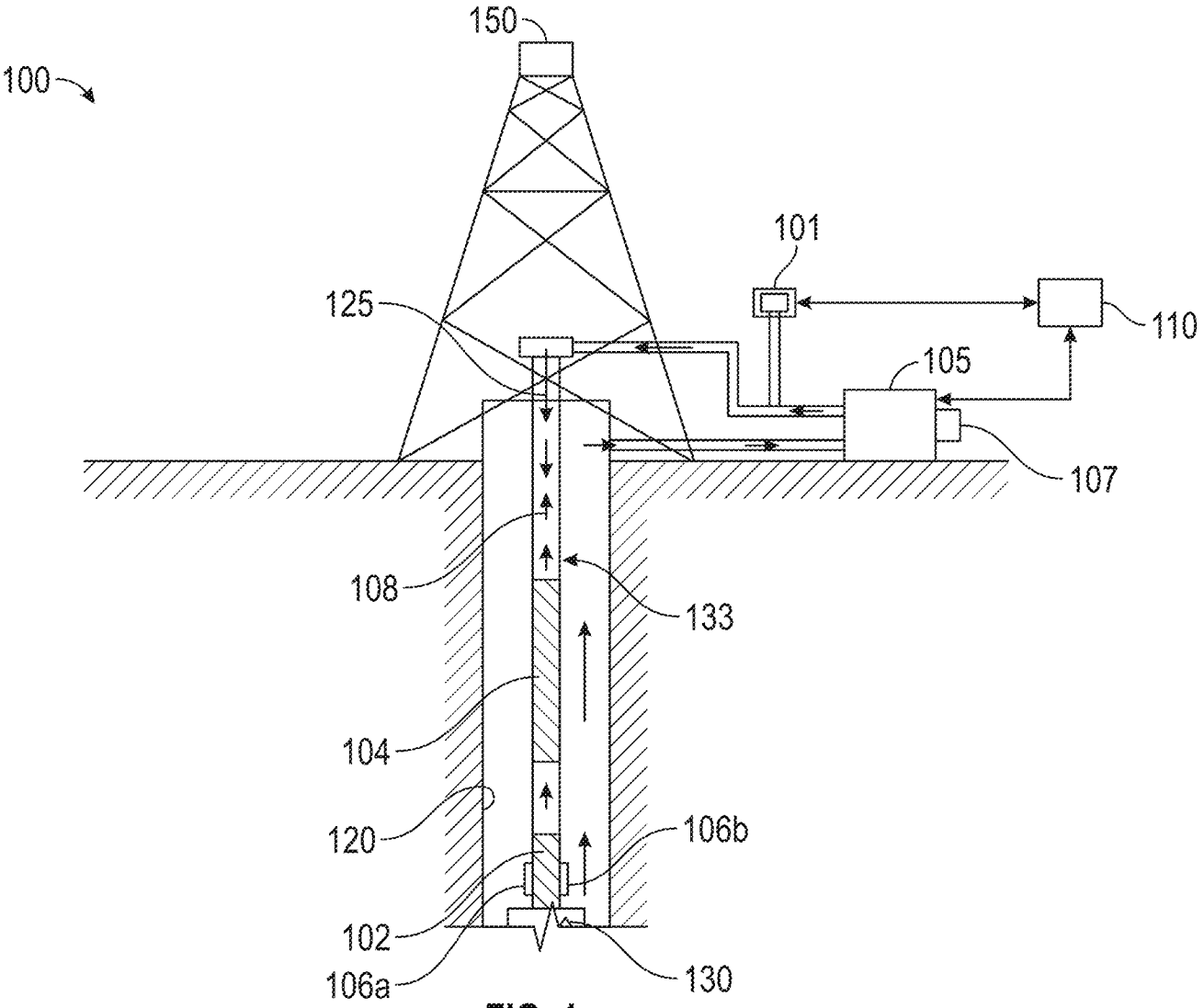
FIG. 1 shows a drilling system according to an illustrative embodiment of the present disclosure.

FIG. 1 illustrates a drilling system 100 using a pressure sensor 101 configured to suppress/filter RSS pad noise in a pulse modulation telemetry configuration, according to certain illustrative embodiments of the present disclosure. Drill system 100 may be a logging while drilling ("LWD") system, as is well known in the oil and gas industry. A pump 105 maintains a mud flow 125 down a wellbore 120 dug by a drill tool 130. A drill string 133 couples drill tool 130 with equipment on the surface, such as mud pump 105 and pressure sensor 101. The tools are supported by drilling rig 150. A controller 110 is coupled to pressure sensor 101, and to mud pump 105, via wellbore 120. Controller 110 may include a computer system configured to receive data from and transmit commands to pressure sensor 101 and pump 105.

Controller 110 includes all necessary software to perform the methods as described herein. Although not shown, this illustrative controller 110 includes at least one processor, a non-transitory, computer-readable storage (e.g., local memory), transceiver/network communication module, optional I/O devices, and an optional display (e.g., user interface), all interconnected via a system bus. Software instructions executable by the processor for implementing software instructions in accordance with the illustrative embodiments and methods described herein, may be stored in a local storage medium or some other computer-readable medium. Although not explicitly shown in FIG. 1, it will be recognized that controller 110 may be connected to one or more public and/or private networks via one or more appropriate network connections via a network communication module. It will also be recognized that the software instructions comprising the methods described herein may also be loaded into local storage from appropriate storage media (e.g. a portable memory/hard drive, a CD-ROM, or the like) via wired or wireless methods.

Moreover, those ordinarily skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Mounted near the drill bit/tool 130, a telemetry unit, such as mud pulser 104, is positioned to encode mud pulse signals to transmit messages to the surface with information related to the drill process or otherwise. Messages created by mud pulser 104 may be digitally encoded sequences of acoustic/mud pressure pulses transmitted through mud flow 125 and read by pressure sensor 101. Accordingly, a plurality of digital signal modulation schemes may be used to transmit messages between mud pulser 104 and pressure sensor 101, such as Pulse Position Modulation ("PPM") and Pulse Width Modulation ("PWM").

As a response to the messages transmitted between pressure sensor 101 and mud pulser 104, controller 110 may adjust a drilling operation or configuration in drilling system 100. For example, a drilling speed may be increased, reduced, or stopped by controller 110, based on messages received from mud pulser 104. Moreover, in some embodiments controller 110 may cause drill tool 130 to steer in a different drilling direction. For example, in some embodiments drill tool 130 may be steered from a vertical drilling configuration (as shown in FIG. 1) to a horizontal or almost horizontal drilling configuration. In some embodiments, adjusting the drilling configuration may include adjusting mud flow 125. For example, mud flow 125 may be increased or reduced, or the pressure exerted by pump 105 may be increased or reduced. Moreover, in some embodiments adjusting the drilling configuration may include adding chemicals and other additives to mud flow 125, or removing additives from mud flow 125.

Still referring to FIG. 1, a stroke monitor 107 is mounted on pump 105 and sends a signal associated with the pump rotation. In some embodiments, stroke monitor 107 includes a sensor that operates as a contact switch, closed for a portion of each revolution of the pump axis.

Drilling system 100 also includes an RSS 102 located near drill bit 130. RSS 102 includes multiple RSS pads **106*a* and 106*b*, although more pads could be used in alternative embodiments. During drilling, pads 106*a* or 106*b*** are actuated outwardly toward the wellbore wall to deflect the drill bit in the desired direction.

As previously mentioned, actuation of RSS pads **106*a,b* result in pressure disturbances that are detected by controller 110 as noise which can reduce telemetry pulse detection or even result in zero pulse detection. The present disclosure describes methods by which to identify those noise signals and filter the noise from the telemetry signals. The frequency of the RSS pad noise is directly related to the RSS pad actuation velocity (or Geostationary Valve Rotation speed). These noises show up at the detection unit (controller 110**) as discrete sinusoidal peaks in the spectrum of the detected signal, which (in the illustrative embodiments described herein) are identified and filtered in real-time. The spectrum of the mud pulser telemetry signal is unique and filtering single sinusoids will not affect the pulser signal. Also, since RSS pad actuation velocity can be obtained separately, it can also be used as a cross-check of the pad noise frequency to be filtered. This disclosure describes four illustrative ways to identify RSS pad noise: (1) identifying peaks in power spectrum of the pulser signals received at the controller, (2) comparing/differencing the spectrum of the pulser signal with a reference spectrum where there was no RSS pad actuation, (3) looking for peaks in the signal when the pulser is not pulsing, and 4) obtaining pad actuation RPM inputs from a separate data source and performing the necessary calculations. These and other illustrative methods will be described herein.

Further, the elastomeric pad or face seals on the RSS pads will degrade over time and eventually fail, causing loss of steerability and erosion of expensive parts. Early detection of RSS leakage (e.g., pad seals) allows for prompt actions to be taken to address/prevent damages caused by leaky seals or other components. Accordingly, illustrative embodiments of the present disclosure provide methods to identify RSS leaks in real time. For example, when there is no leaky seal on the RSS pads, the pad noise frequency equals to [(single pad actuation RPM)*(number of pads)/60]+its harmonics. When the RSS pad's actuation velocity or Geostationary valve rotational speed is 120 RPM, the pad noise frequencies are 6 Hz, 12 Hz, 18 hz, etc. When there is a leaky pad, the additional noise created by the leaky pad will have a frequency of (single pad actuation RPM)*1/60. Therefore, at 120 RPM, the additional noise spikes are 2 Hz, 4 Hz, 6 Hz, 8 Hz, 10 Hz, . . . etc.). In the illustrative methods described herein, controller 110 detects these spikes in the telemetry signals to thereby detect pad seal leaks in real-time.

Referring back to FIG. 1, during operation, pulser 104 sends short pressure pulses (data-carrying pulses) travelling to the well surface. These pressure pulses are picked up by pressure sensors 101 and decoded by controller 110. Any pressure perturbation caused by components/phenomena other than pulser 104, such as RSS pads 106*a* or *b*, will become a noise signal that affects detection quality, data rate, or SNR of the data carrying signal. Push-the-bit RSS tools, such as RSS 102, use mud pressure to actuate steering pads 106*a* and 106*b* through a valve. The opening and closing of this valve results in bore pressure fluctuations in several ways. First, when the RSS pad is equipped with a nozzle, opening the valve to one steering pad will cause a pressure drop. Second, when there is no nozzle, a water hammer effect may cause a pressure spike. Third, the displacement of the pad piston will cause a pressure drop. Lastly, for example, if the pad seal is leaking, opening the valve to the pad will also cause a pressure drop. These pressure fluctuations, although small in amplitude can travel to the surface with the data-carrying pulses and interfere with mud pulse detection. In some cases, zero pulse detection has been encountered while drilling due to these pad noises.

Figure 2A:
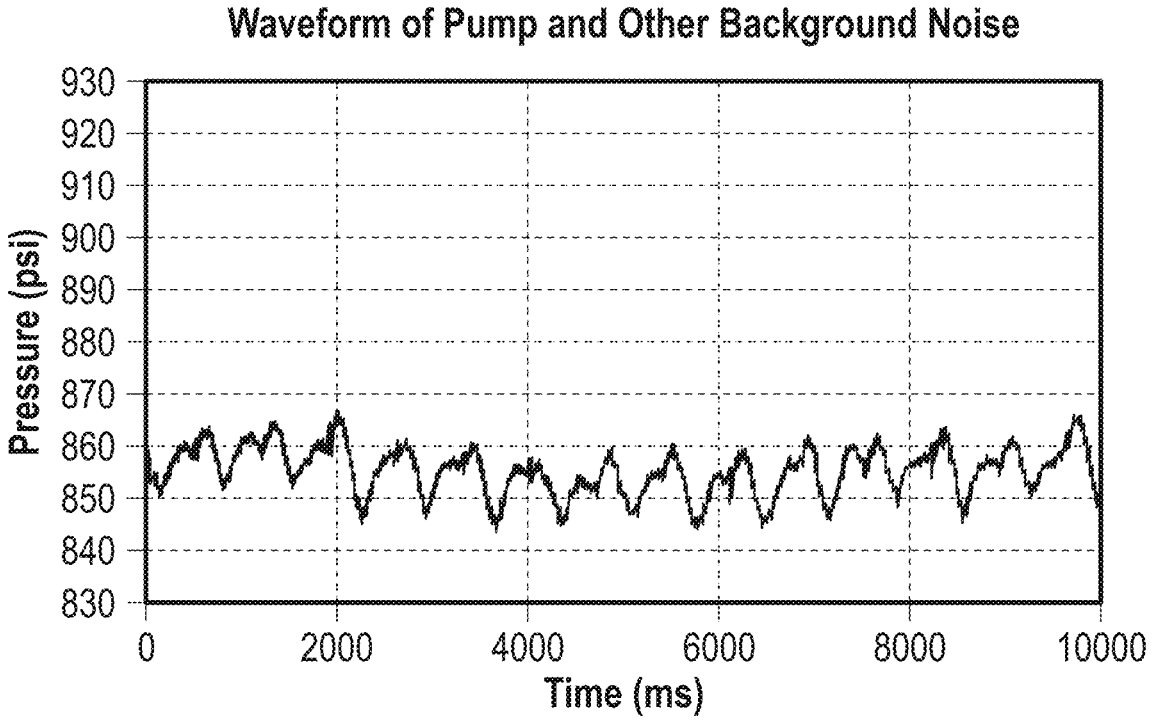
FIGS. 2A and 2B are graphical illustrations a pressure waveform and power frequency spectrum, respectively, of signals generated by a pump and other background noise when the pulser and RSS pads are inactive.
Figure 2B:
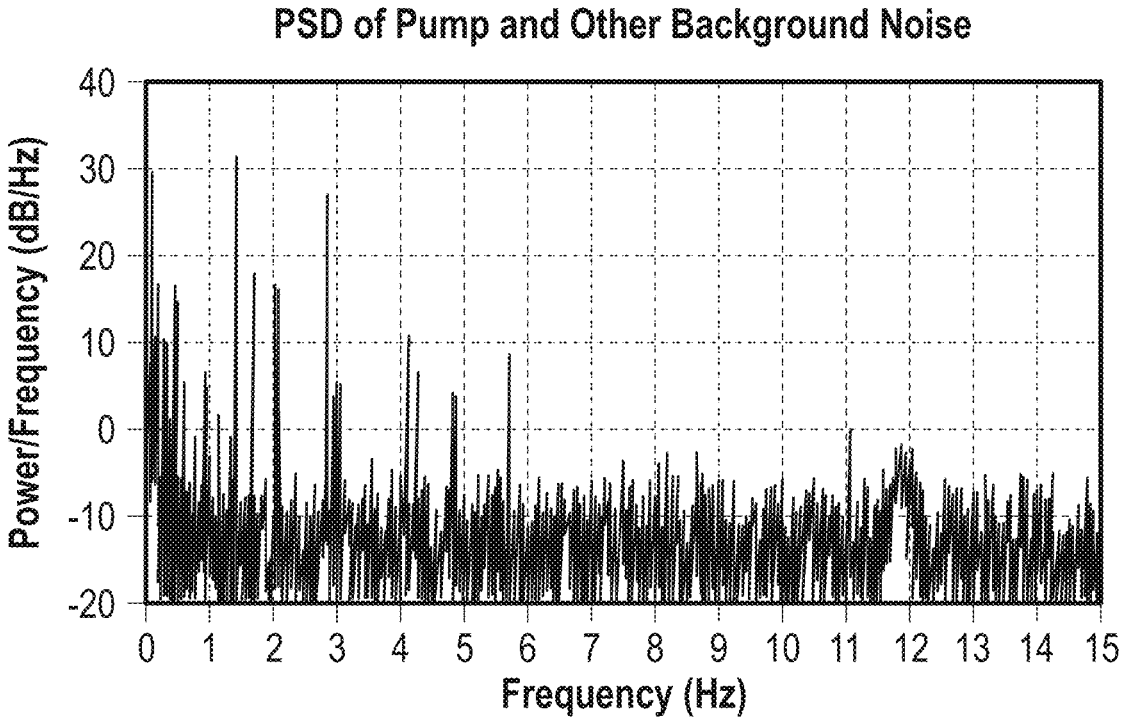

Accordingly, methods of the present disclosure identify and filter the RSS pad noise in the data-carrying pulses using adaptive filters produced using spectrum analysis. The RSS pad noise has been characterized through flow loop tests and found to show up as discrete sinusoidal peaks in the power spectrum. These peak frequencies are directly proportional to the RSS pad actuation speed, the number of pads, and the number of pads with leaky seals. When the pulser is not pulsing and RSS pads are not being activated, the pressure waveform obtained at the controller is only the pump noise (from mud pump 105) and other background noise. An example of this is shown in FIGS. 2A and 2B. FIG. 2A is a graphical representation of a pressure waveform of signal generated by a pump and other background noise only (the pulser and RSS pads are inactive). FIG. 2B is a graphical representation of a power frequency spectrum of the pump and background noise only (the mud pulser and RSS pads are inactive).

Figure 3A:
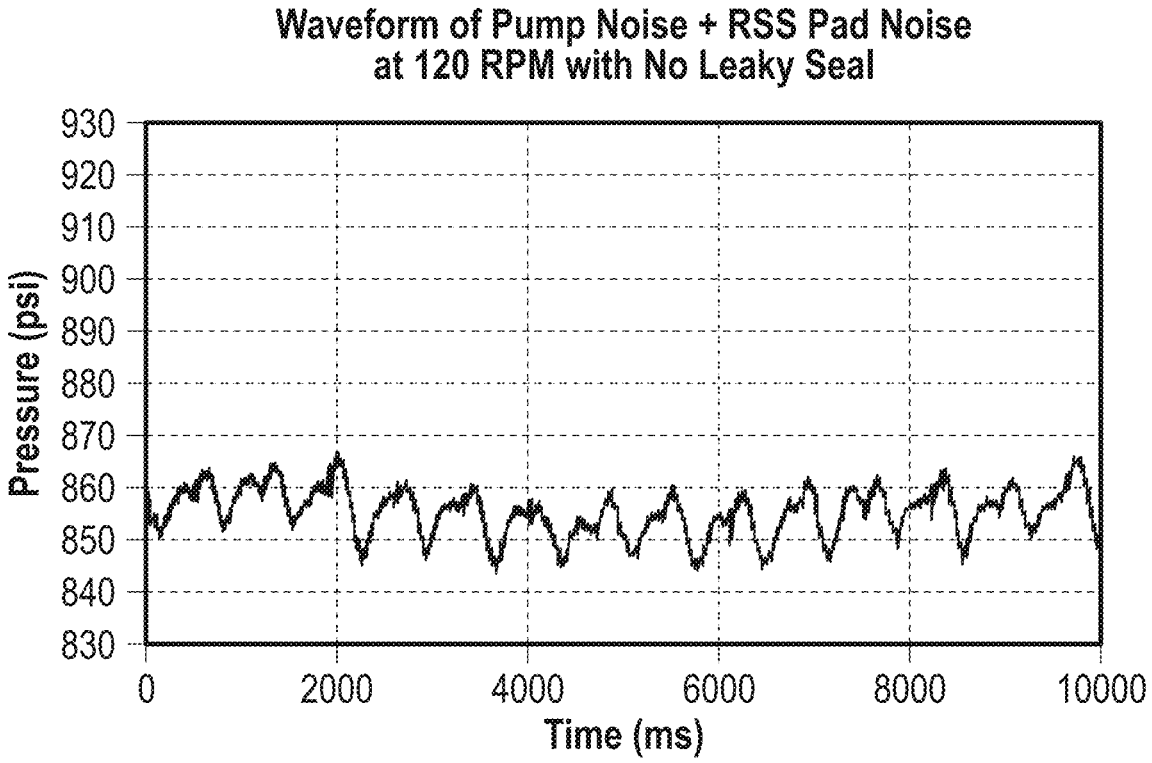
FIGS. 3A and 3B are graphical representations of signals generated when the RSS pads are actuated without any leaky seals at 120 RPM.
Figure 3B:
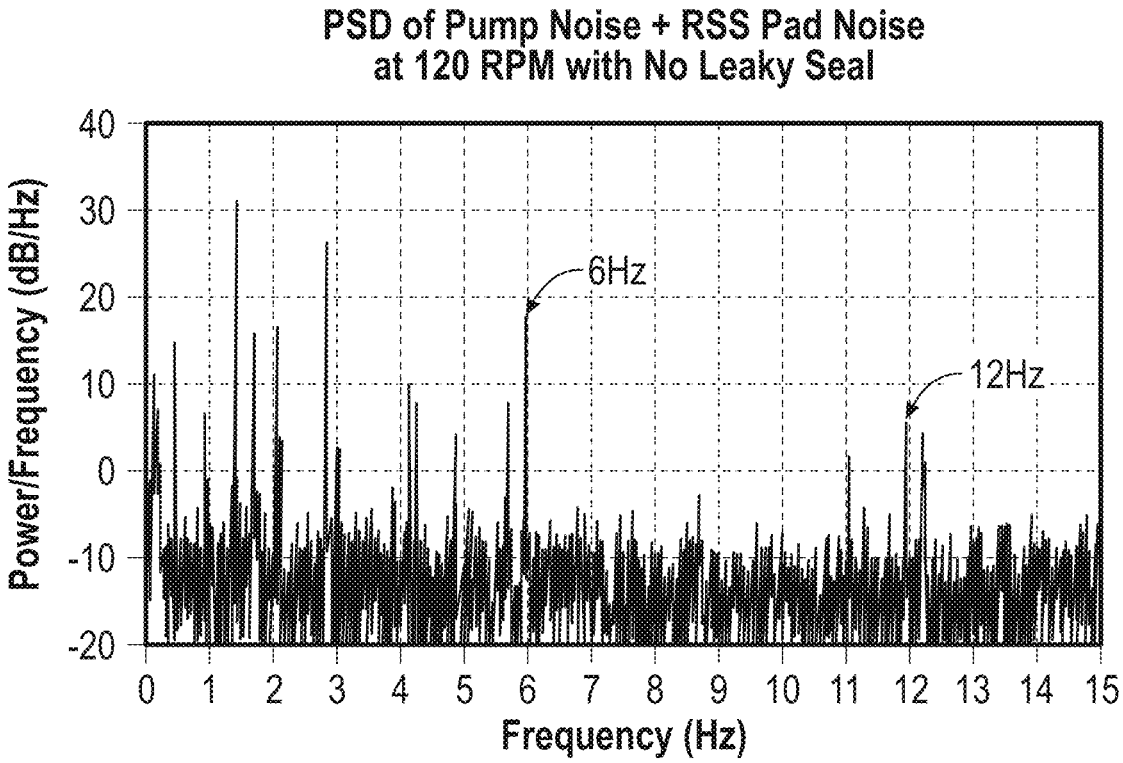

FIGS. 3A and 3B are graphical representations of signals generated when the RSS pads are actuated without any leaky seals at 120 RPM. In such cases, the pressure waveform obtained is comprised of the mud pump/background noise and the RSS pad noise, as shown in FIG. 3A. Comparing the spectra in FIGS. 2A-2B with those in FIGS. 3A-3B, there are two new peaks at 6 Hz and 12 Hz (and its harmonics) when RSS pads are actuated at 120 RPM. Such an analysis is straight forward because there are 3 pads in this illustrative RSS tool and the base frequency will equal to RPM*number of pads/60=120*3/60=6 Hz.

Figure 4A:
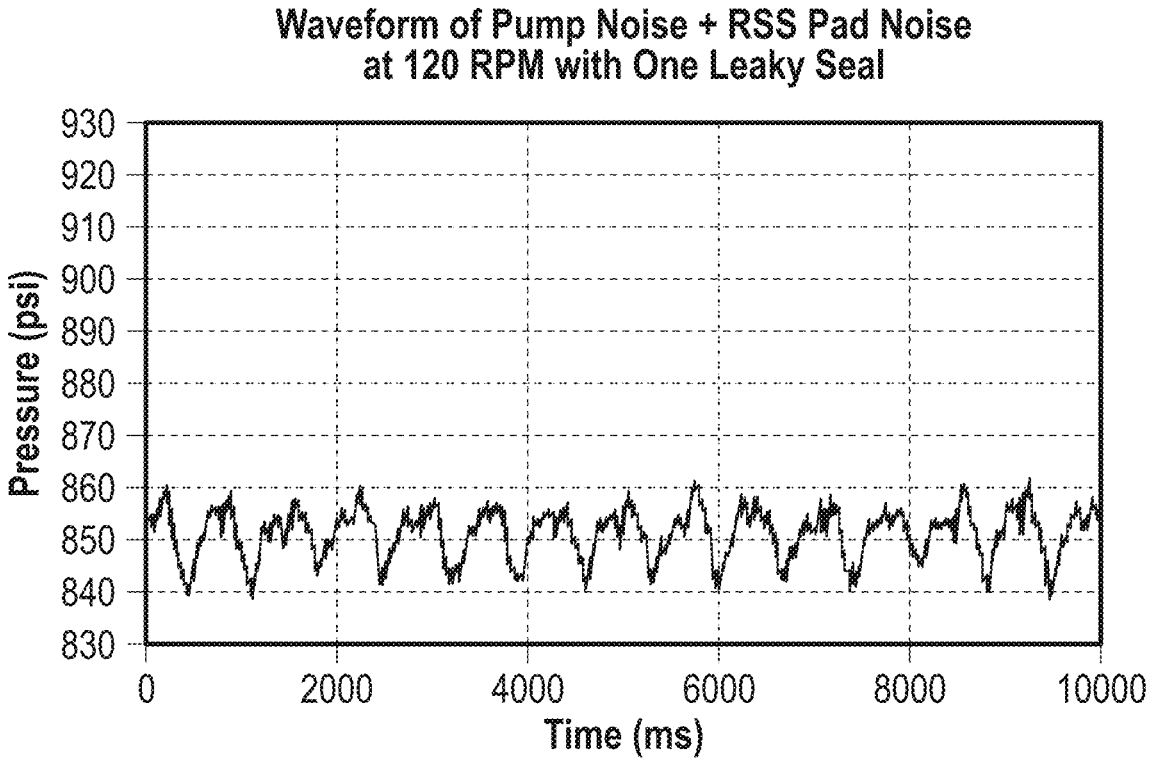
FIGS. 4A and 4B are graphical representations of signals generated when three RSS pads are actuated at 120 RPM and one has a leaky pad.
Figure 4B:
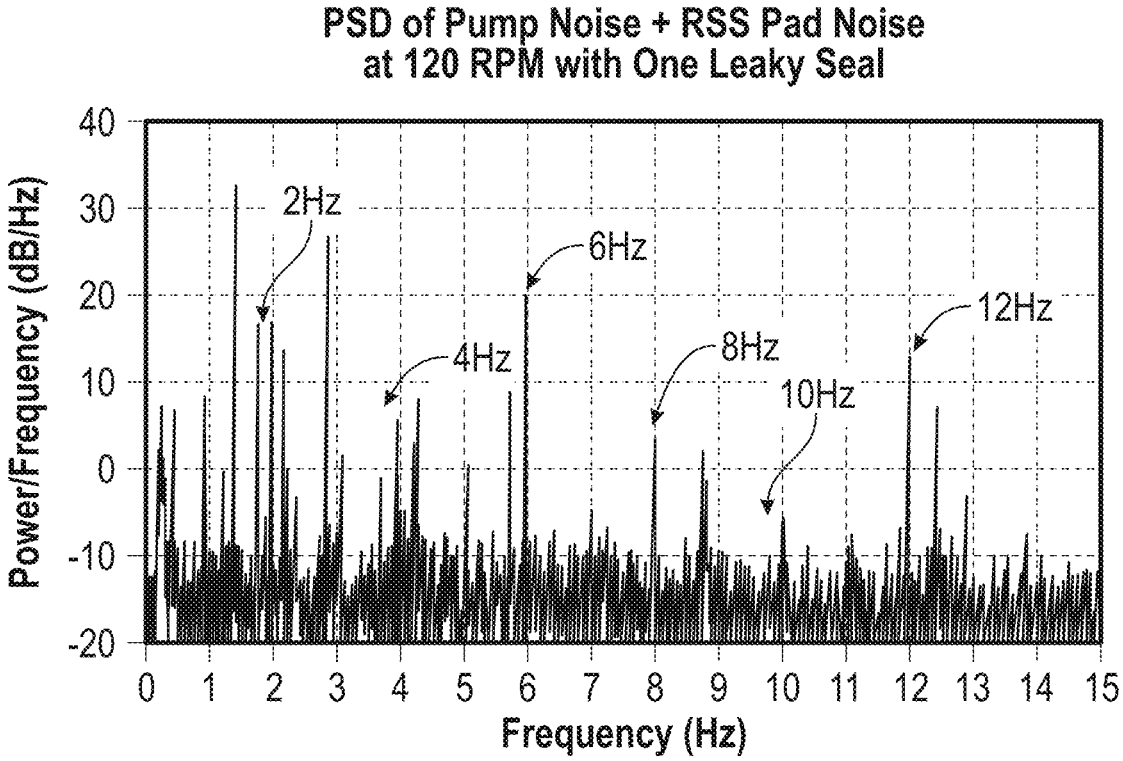

FIGS. 4A and 4B are graphical representations of signals generated when three RSS pads are actuated at 120 RPM and one has a leaky pad. FIG. 4A shows a pressure waveform including the pump noise, RSS pad noise at 120 RPM with one leaky seal. FIG. 4B shows a power spectrum of the pump noise and RSS pad noise at 120 RPM with one leaky seal. As one can see, in addition to the three pad actuation noise frequencies (6 Hz and its harmonics), there are peaks at 2 Hz and its harmonics. Therefore, when one pad seal is leaking, the steady state pad pressure will be lower than the non-leaky pads, which will have a base frequency of RPM*number of leaky pads/60=120*1/60=2 Hz.

Figure 5A:
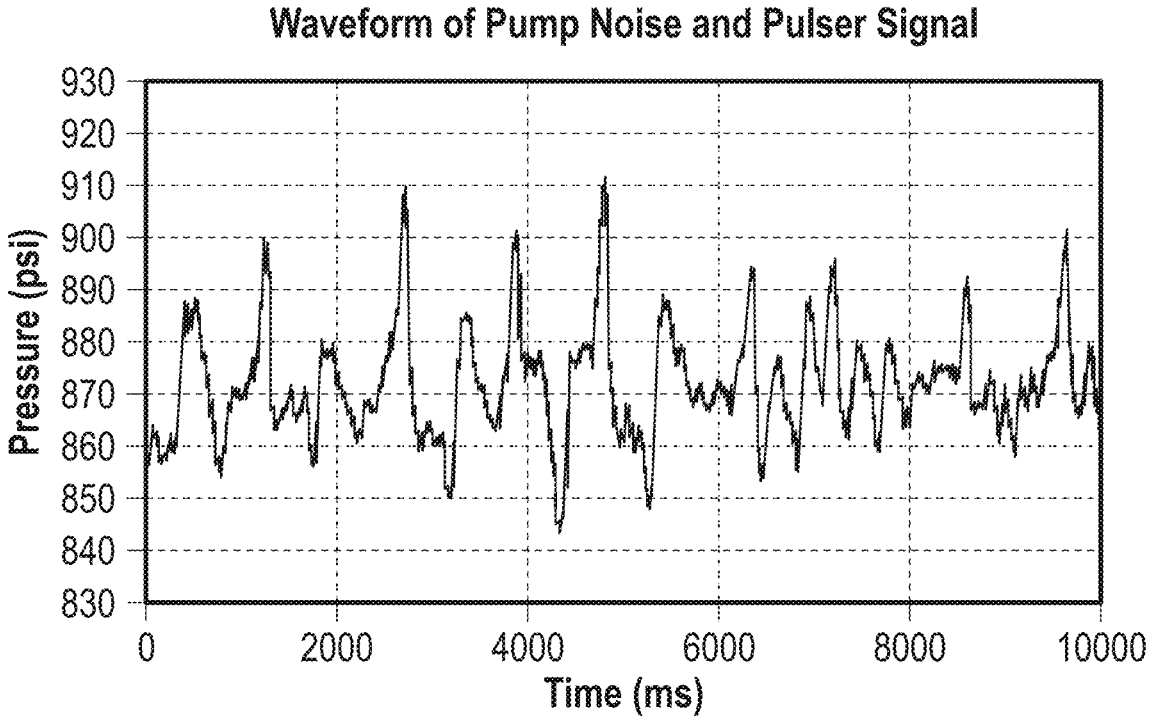
FIGS. 5A and 5B are graphical representations illustrating the pressure signature when the pulser is pulsing and the RSS pads are not being activated.
Figure 5B:
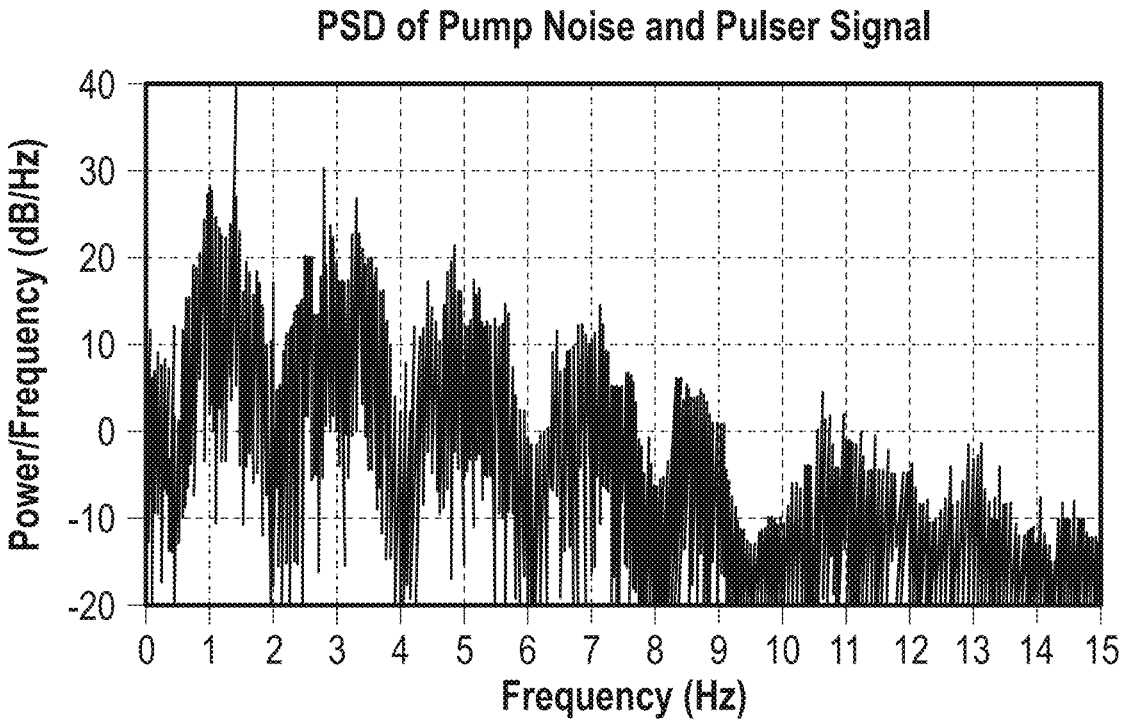

FIGS. 5A and 5B are graphical representations illustrating the pressure signature when the pulser is pulsing and the RSS pads are not being activated. FIG. 5A shows the pressure waveform of the pump noise and pulser signal, while 5B shows the power spectrum of the pump noise and pulser signal. The waveforms show the superposition of the pump noise and pulser signal. Whenever there is a pulser signal, there will be pump noise. The superposition is an observation that the pump noise peaks observed when not pulsing still show up as added spikes on the spectrum when the pulser is pulsing. Having knowledge of the pump noise characteristics assists in the design of the pump noise filter without needing to filter out the pulser signal.

Figure 6A:
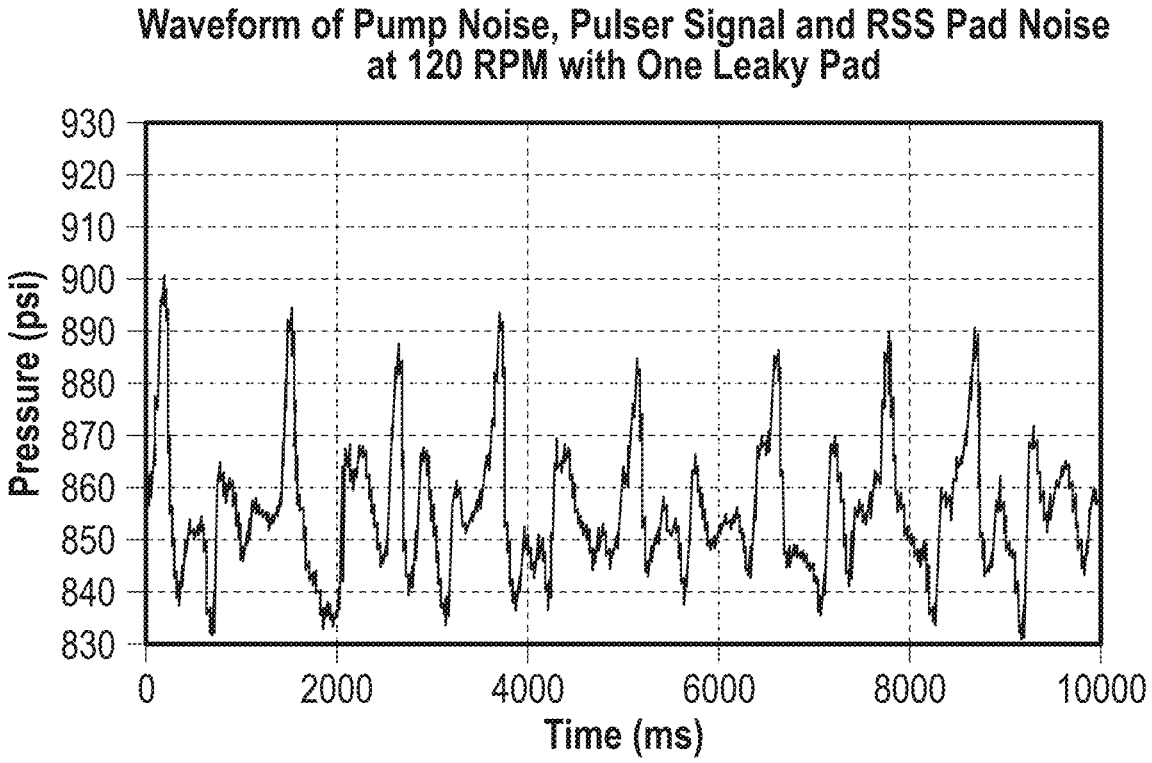
FIGS. 6A and 6B are graphical illustrations of waveforms when the pulser is pulsing and RSS pads are being actuated at 120 RPM, and there is one leaky pad.
Figure 6B:
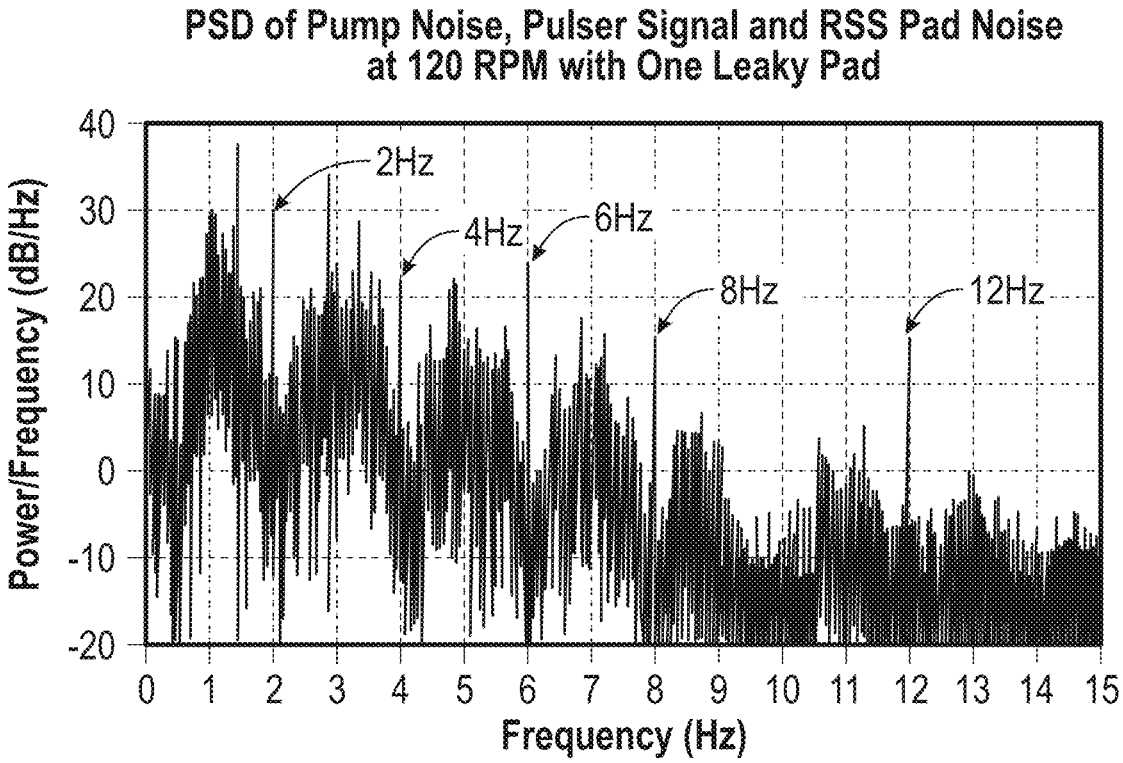

FIGS. 6A and 6B are graphical illustrations of waveforms when the pulser is pulsing and RSS pads are being actuated at 120 RPM, and there is one leaky pad. FIG. 6A shows the pressure waveform of the pump noise, pulser signal and RSS pad noise at 120 RPM with one leaky pad. FIG. 6B is the power spectrum of the pump noise, pulser signal and RSS pad noise at 120 RPM with one leaky pad. As can be seen, this also shows the spectrum is a superposition of the pump noise, pulser signal, and the RSS pad noise (2 Hz, 6 Hz and their harmonics).

Figure 7A:
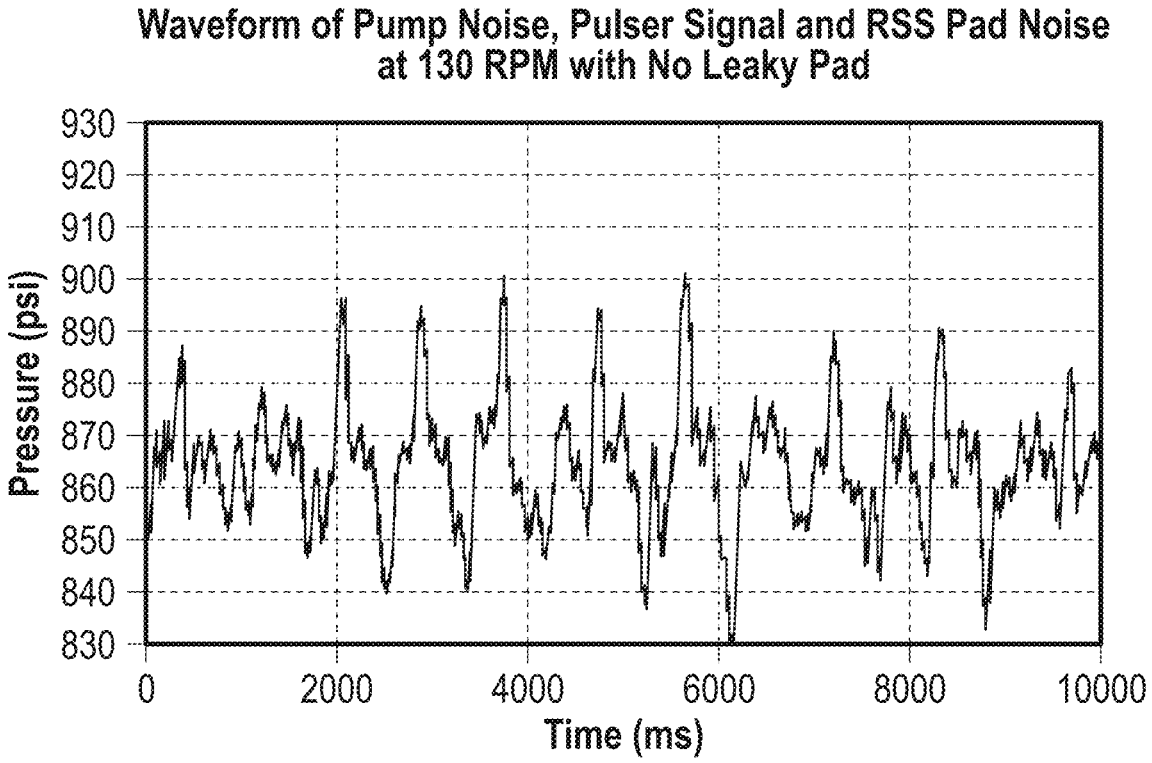
FIGS. 7A and 7B are graphical representations illustrating the waveforms when the pulser is pulsing and the RSS pads are being actuated at 130 RPM, and there are no leaky pads.
Figure 7B:
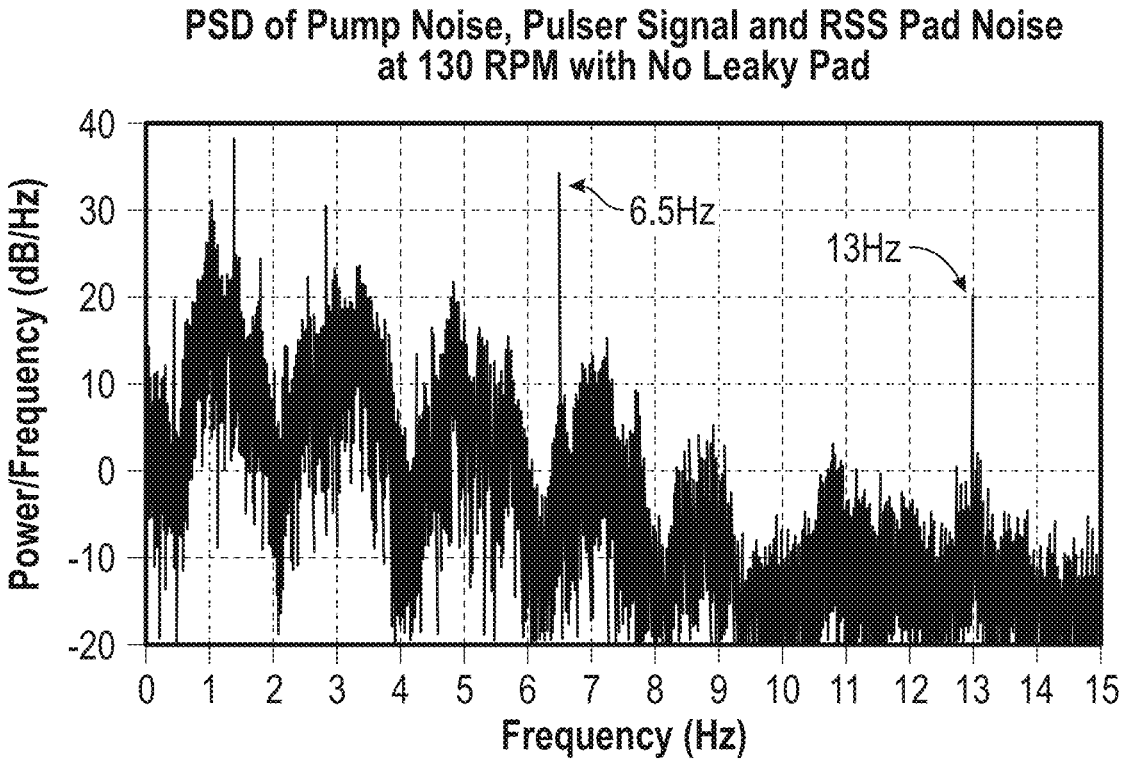

FIGS. 7A and 7B are graphical representations illustrating the waveforms when the pulser is pulsing and the RSS pads are being actuated at 130 RPM, and there are no leaky pads. FIG. 7A shows the pressure waveform comprising the pump noise, pulser signal and RSS pad noise at 130 RPM with no leaky pad, while FIG. 7B shows the power spectrum of the pump noise, pulser signal and RSS pad noise at 130 RPM with no leaky pad. Again, the RSS pad noise frequency of 6.5 Hz and its harmonics can clearly be seen.

The graphs described above illustrate how RSS pump noise and leaky pads have detrimental effects on the telemetry signals received at the detection units. In certain illustrative embodiments, the pump noise may be dealt with using a variety of adaptive filters, as will be understood by those ordinarily skilled in the art upon reading this disclosure. However, the RSS pad noise, although small in pressure amplitude, also severely interferes with mud pulse detection. For example, in testing of the present disclosure, the pad noise shown in FIGS. 6A-6B caused a poor detection quality of 35% and the pad noise in FIGS. 7A-7B 7 caused a poor detection quality of 46.4%. Zero detection has also been encountered while drilling in certain wells.

To combat this phenomenon, illustrative methods of the present disclosure are applied to identify RSS pad noise frequency in real-time. Thereafter, frequency analysis of the spectrum of detected pressure is performed and distinctive peaks and harmonics are identified and filtered using the adaptive filters described herein. The frequency analysis may be performed in a variety of ways. In one illustrative method, the controller obtains a spectrum when the RSS pad is not running or running at a low speed (e.g., up to 10 RPM or neutral mode). The controller then applies this as a baseline reference to compare to the data-carrying signal detected when the RSS pad is running. The comparison allows the controller to identify the pad noise frequency. In an alternative method, the controller obtains a spectrum when the pulser is not running, but the pad is running. Thus, the detected spectrum includes the RSS pad noise which is identified by the controller. Once identified, the controller then filters the noise frequencies.

Figure 8A:
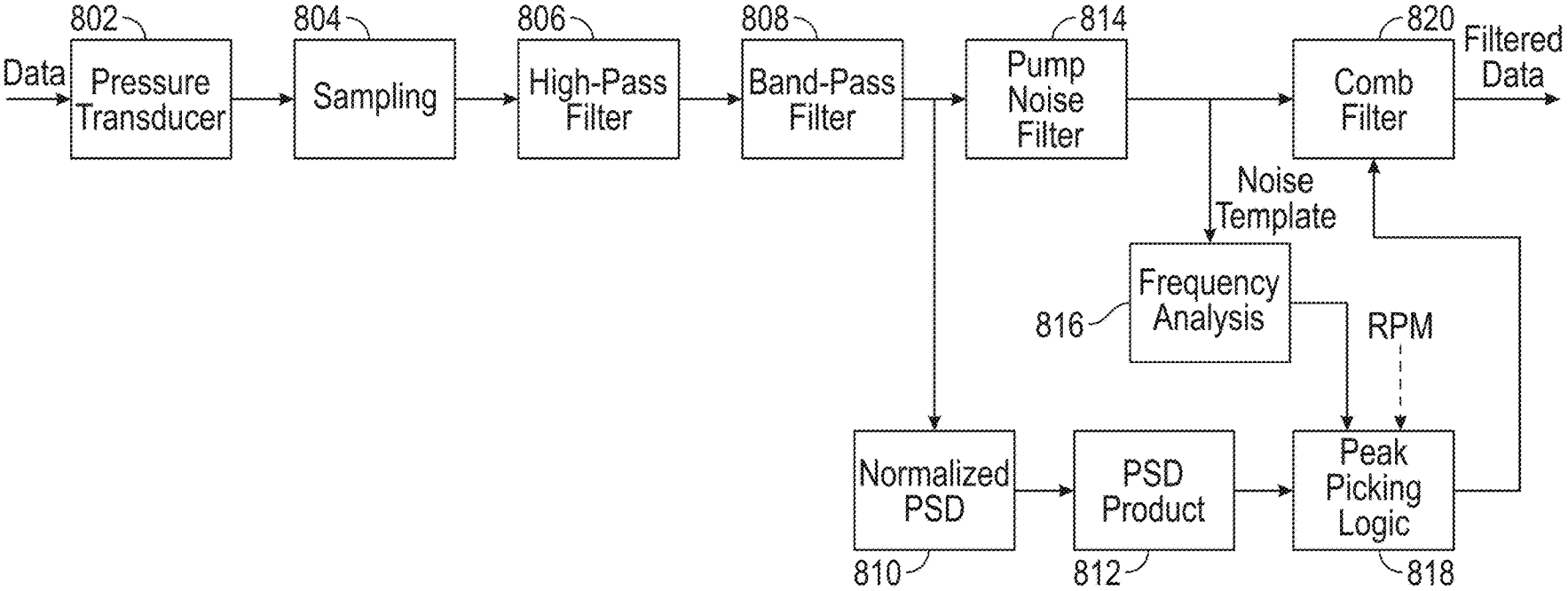
FIG. 8A is a block diagram of a detailed workflow describing a pad noise detection and mitigation method, according to certain illustrative methods of the present disclosure.

FIG. 8A is a block diagram of a detailed workflow describing a pad noise detection and mitigation method, according to certain illustrative methods of the present disclosure. Using sensor 101 and controller 110, the discrete data (data-carrying signal) generated by pulser 104 (which includes RSS pad noise) at block 802 is sampled at block 804 by sensor 101/controller 110. At block 806, the sampled spectrum is first passed through a high-pass filter in order to remove any dc bias present. At block 808, the data is then band limited using a band-pass filter. At block 810, a normalized power spectrum $S_{xx}(n,k)$ is computed in logarithmic units for each overlapping band-limited data frame of length N with an overlapping factor P where k denotes frequency index and n is the frame index. For obtaining the most significant spectral peaks corresponding to noises, at block 812, a product of M power spectra (i.e., power spectral density or PSD) is computed after zeroing the negative magnitudes as:

$$\bar{S}_{xx}(n,k)=\Pi_{i=n-M+1}^{n} S_{xx}(i,k) \quad \text{Eq. 1}$$

where i is used for frame index.

At block 814, mitigation of pump noise (generated by mud pump 105) is achieved by means of a pump noise filter. At block 816, frequency analysis is performed to identify the pump noise frequency. In an illustrative method, the pump noise frequency is identified either by comparing the frequency spectrum of input and output of the pump noise filter or from the frequency spectrum of the pump noise template, estimated by the pump noise filter. The pump noise template is estimated by the pump noise filtering algorithm once the pumps are 'ON' and updated on the fly. When the pumps are 'ON' and there is no data, the pump noise filtering algorithm estimates the pump noise. This noise profile is continuously updated on the fly adaptively. The pump noise frequency can be determined from this noise profile.

With the knowledge of pump noise frequency component, the frequencies corresponding to pad noise are identified using a peak picking logic at 818. It may be noted that, optionally, RPM information of the RSS 102 can be used to define a search window for finding the peaks corresponding to pad noise. Knowing the pad noise frequencies, either a comb filter or a cascaded notch filer can be designed in order to remove the pad noise at block 820. Thereafter, the filter coefficients may be periodically updated based on the pad noise frequency obtained.

Figure 8B:
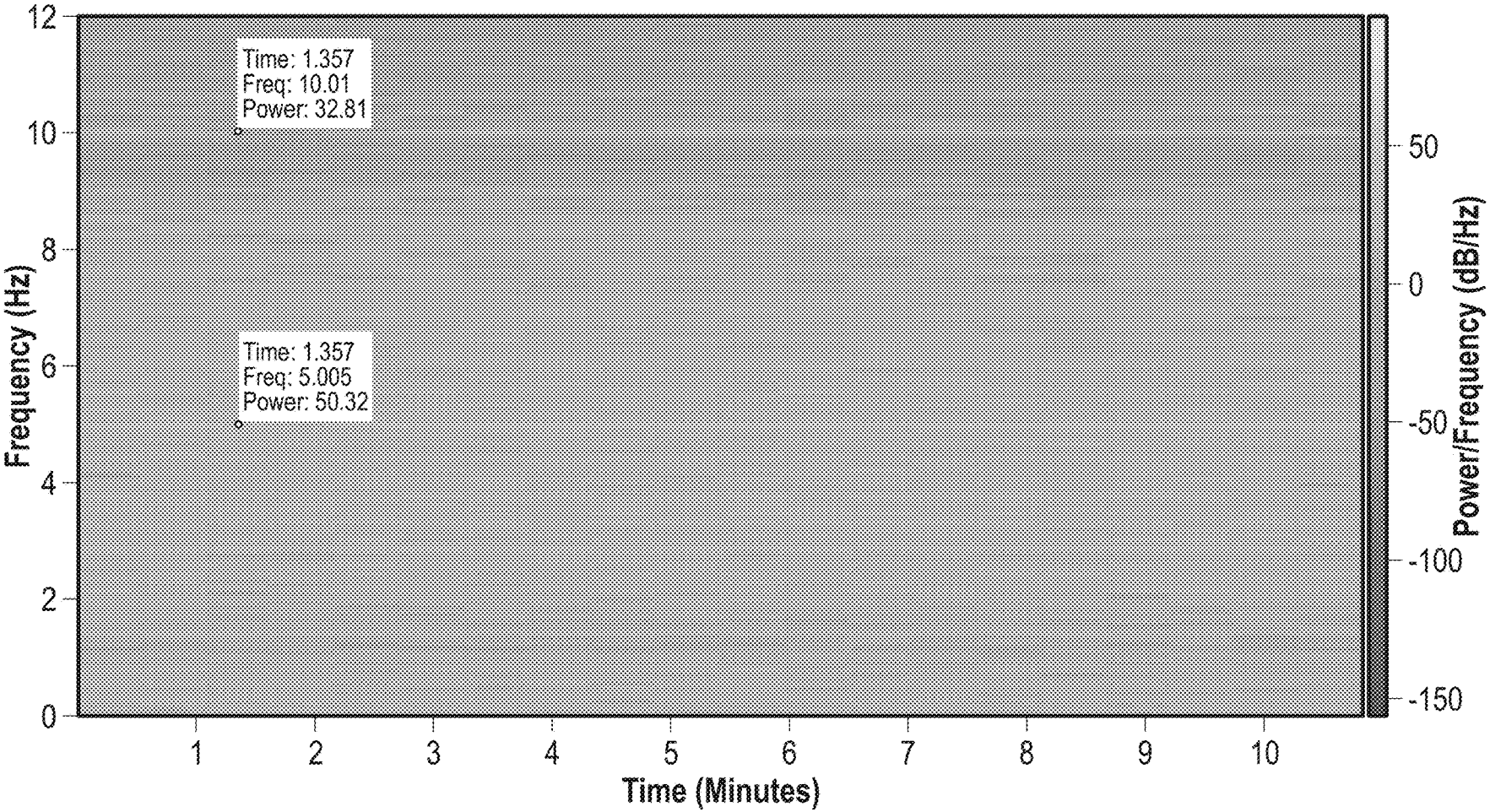
FIG. 8B is a spectrogram of data contaminated with pad noise corresponding to one leaky pad.
Figure 8C:
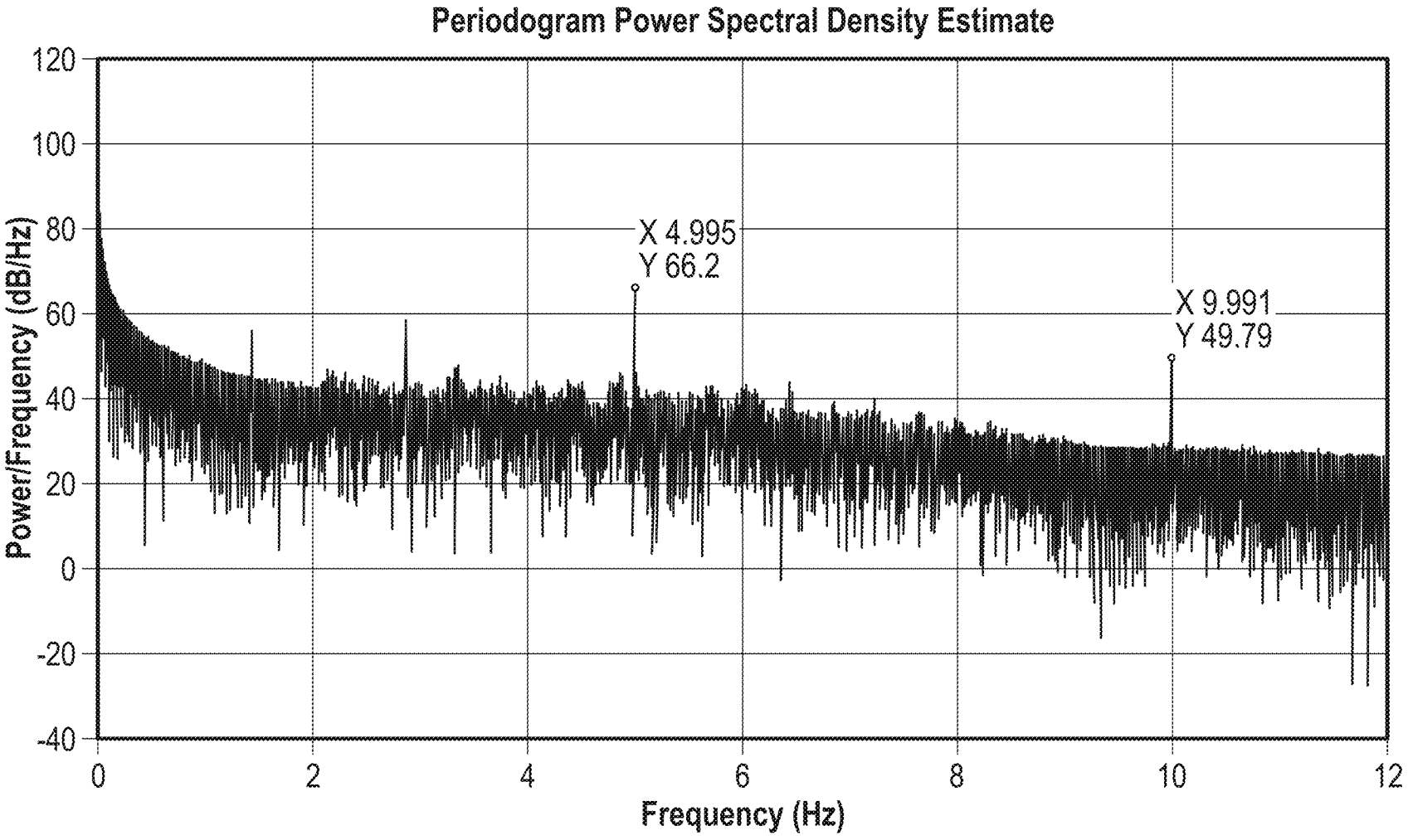
FIG. 8C is a periodogram of noisy data.
Figure 8D:
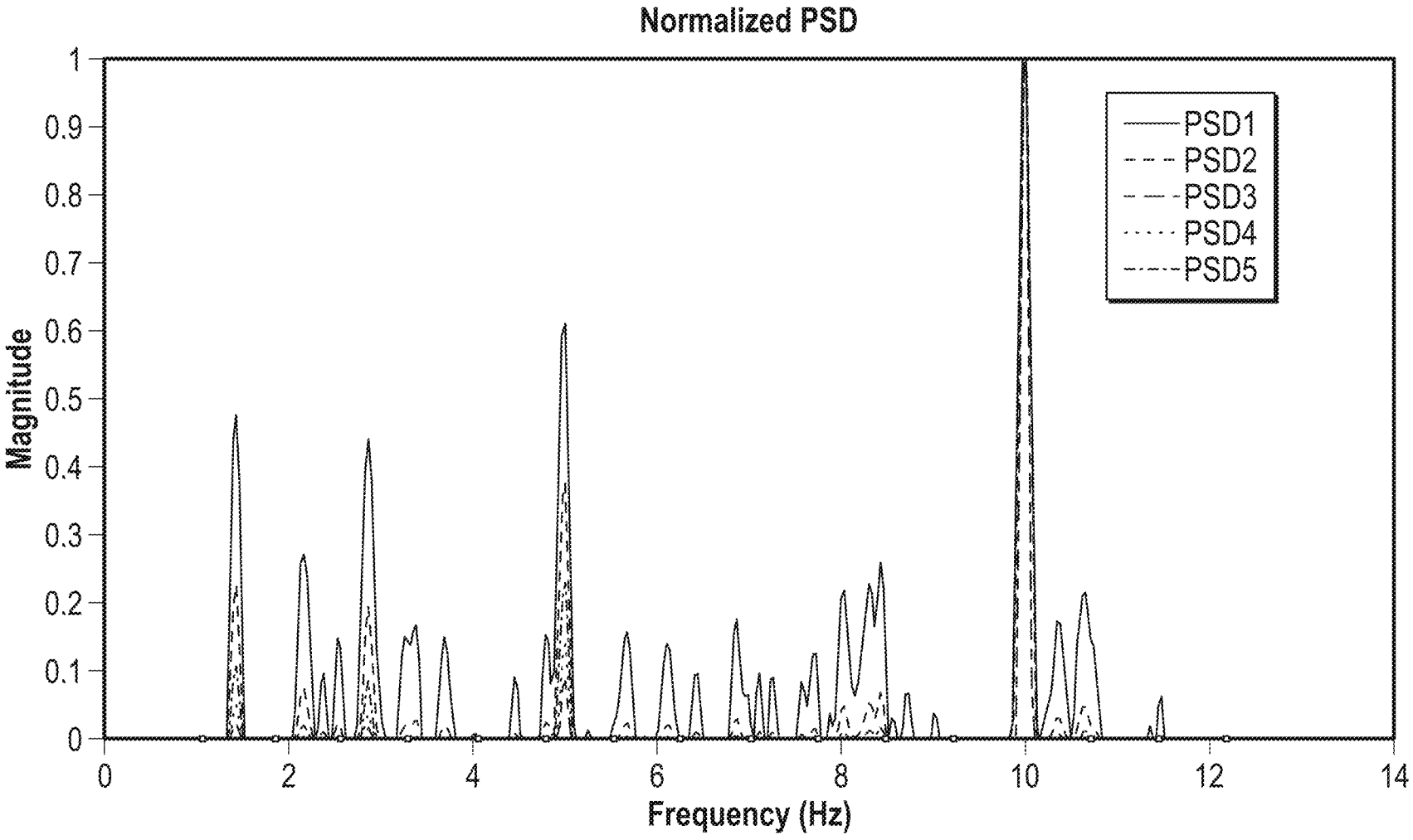
FIG. 8D is a normalized PSD computed for five frames.

To illustrate the performance of the method described in FIG. 8A, FIG. 8B is a spectrogram of data contaminated with pad noise corresponding to one leaky pad. FIG. 8C is a periodogram of noisy data, and FIG. 8D is a normalized PSD computed for five frames. The illustrative tool was rotated with 300 RPM and hence the expected pad noise frequency would be around 5 Hz and its multiples. From FIGS. 8A-8B and the periodogram shown in FIG. 8C, it can be seen that, other than pump noise, a 5 Hz component and its first harmonic corresponding to leaky pad noise are present in the data.

Figure 8E:
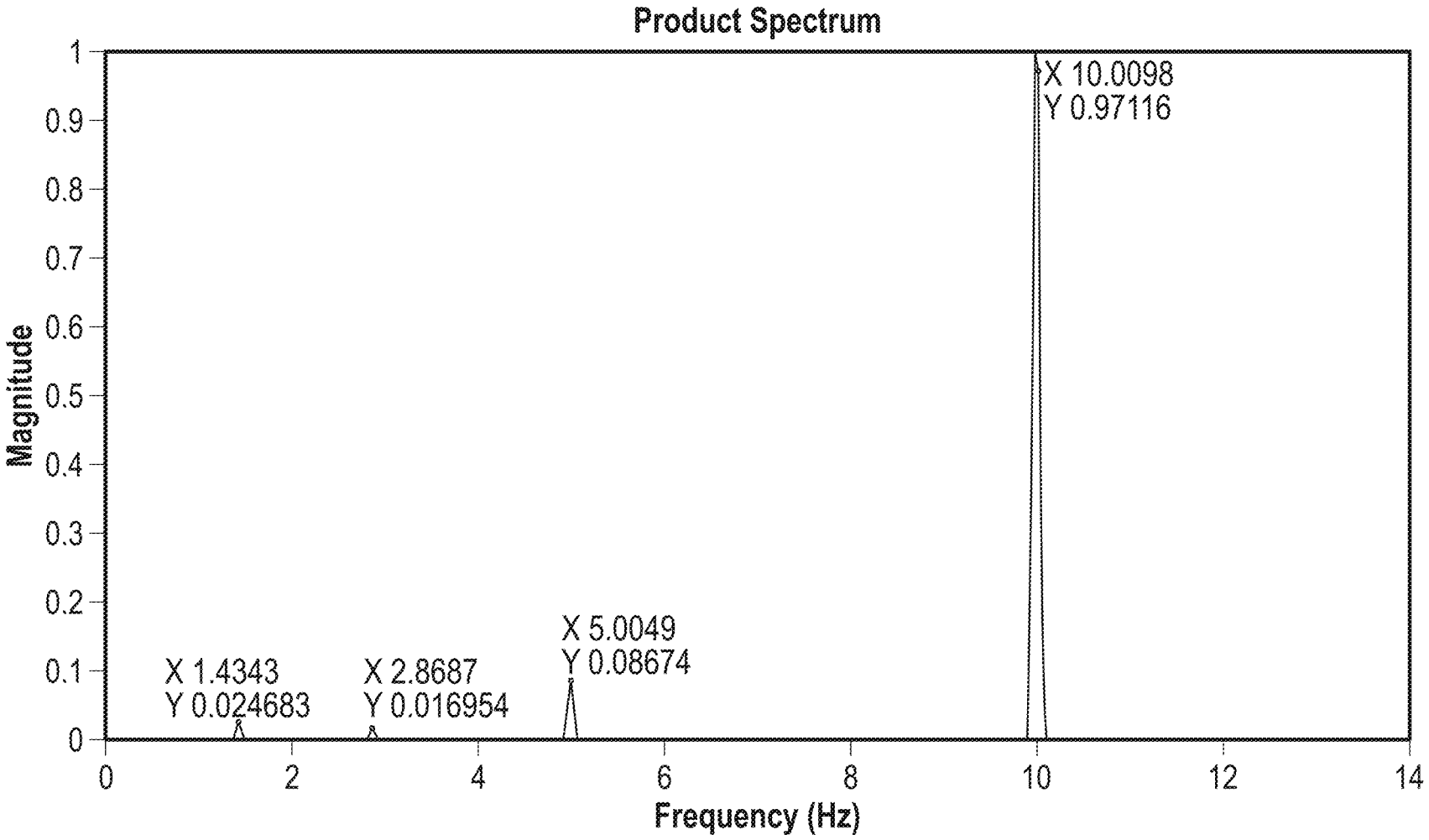
FIG. 8E is a product spectrum showing four peaks at nearly 1.43 Hz, 2.86 Hz, 5 Hz and 10 Hz.
Figure 8F:
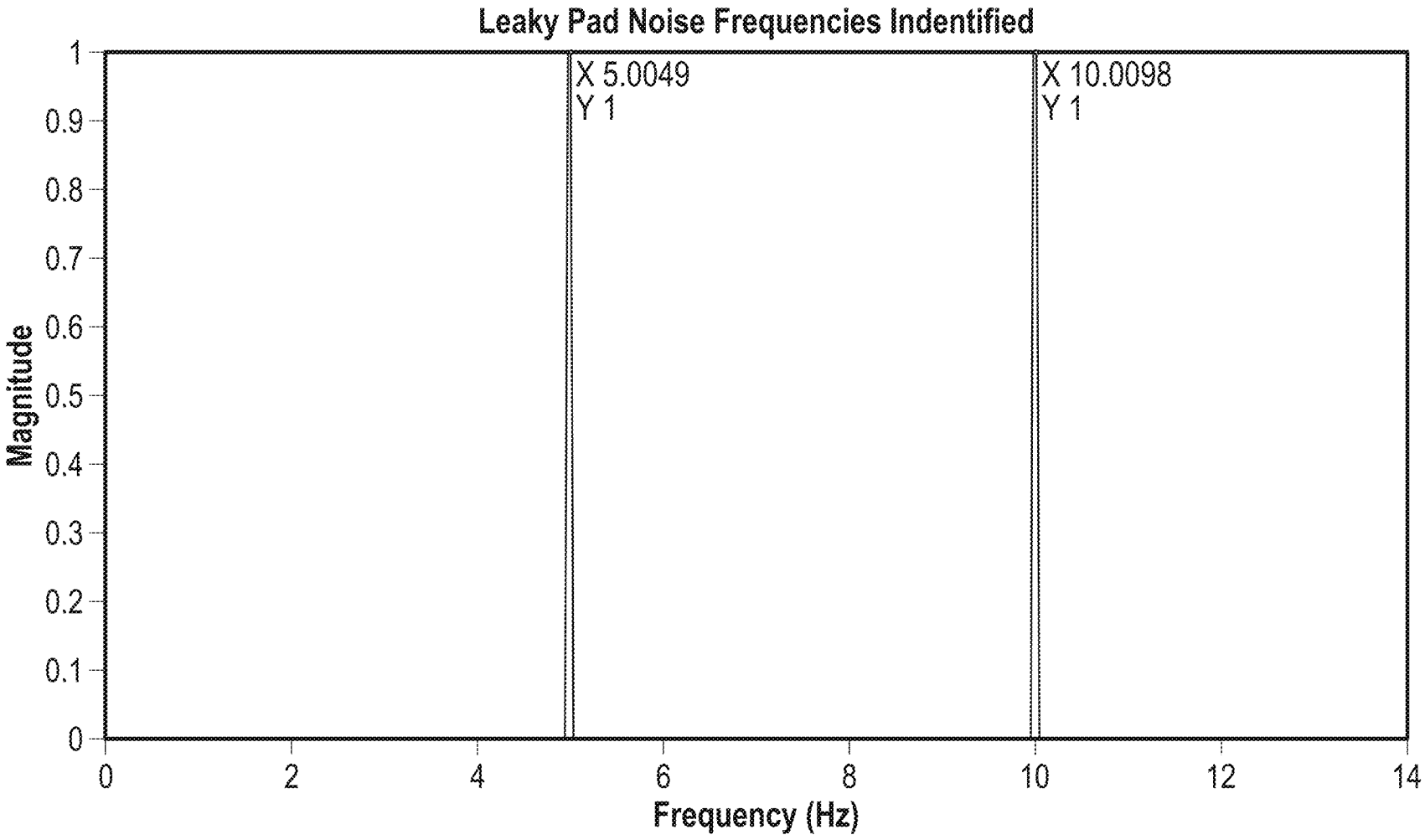
FIG. 8F illustrates pad frequencies identified by an illustrative peak picking method of the present disclosure.

Normalized PSD computed with N=32768 and P=512 for M=5 frames are shown in FIG. 8D. Peaks corresponding to noises can easily be identified from FIG. 8D. The product spectrum $\bar{S}_{xx}(n,k)$ presented in FIG. 8E shows four peaks at nearly 1.43 Hz, 2.86 Hz, 5 Hz and 10 Hz. By analysing pump noise template, it was determined that 1.43 Hz and its first harmonic correspond to pump noise. The leaky pad noise frequencies identified by the method are shown in FIG. 8F. It may be noted that the frequency components shown in the figures may slightly vary as the frequency resolution used for processing the data was not same as that used for analysing the data.

Figure 8G:
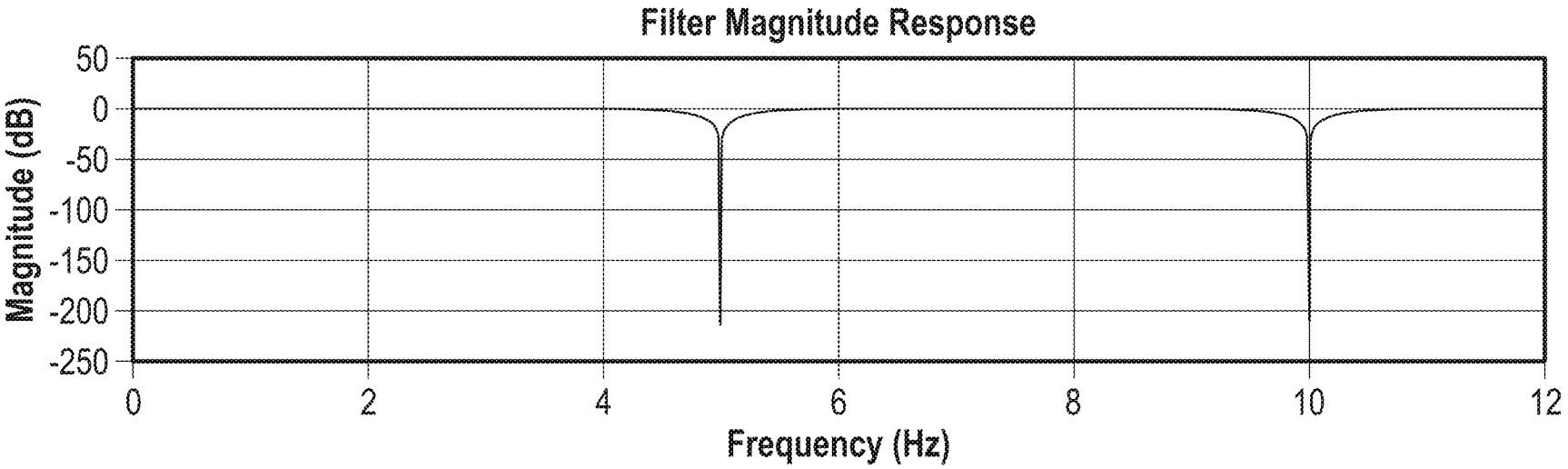
FIG. 8G shows the filter response.
Figure 8H:
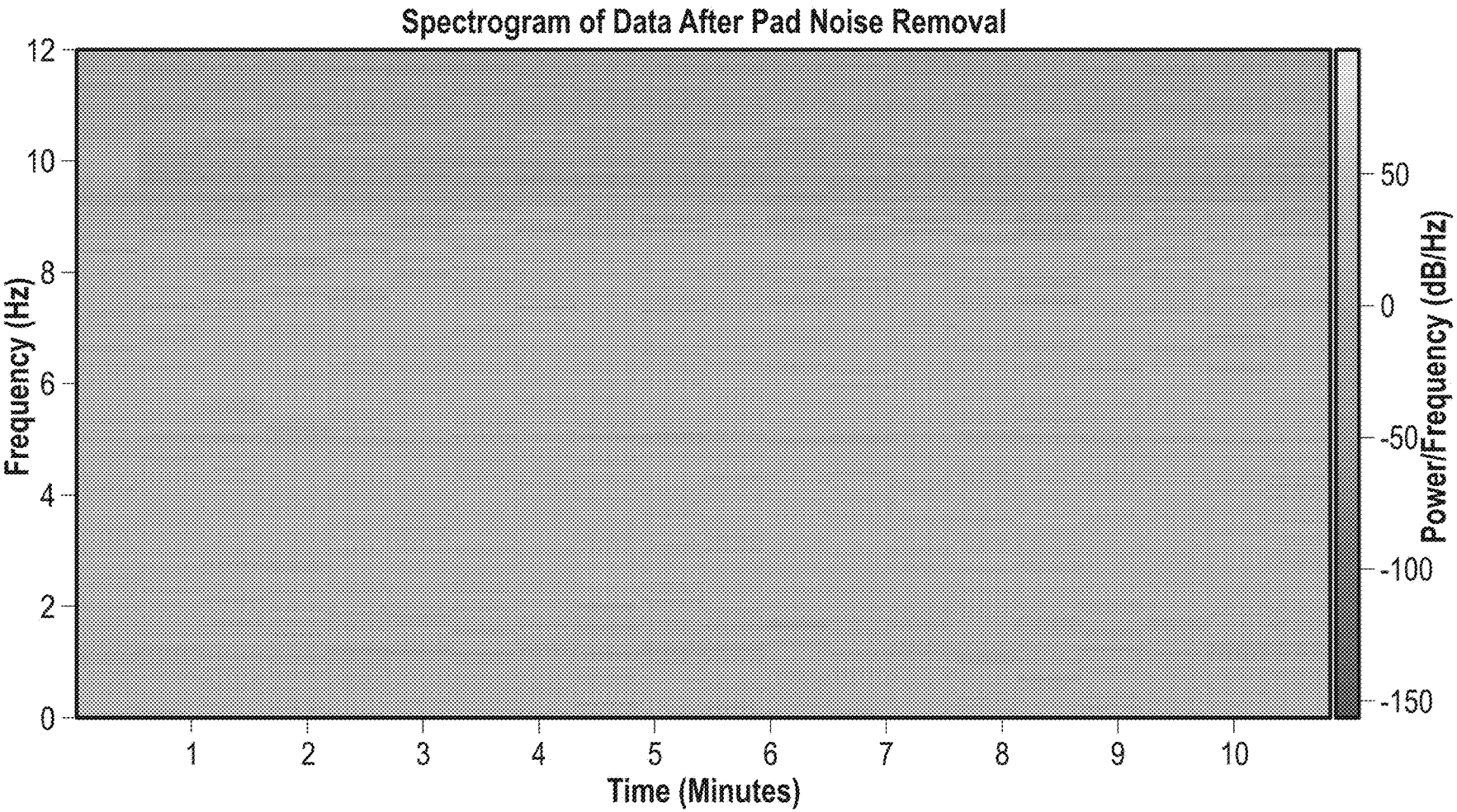
FIGS. 8H and 8I illustrate, respectively, the spectrogram and power spectral density of the filtered data.
Figure 8I:
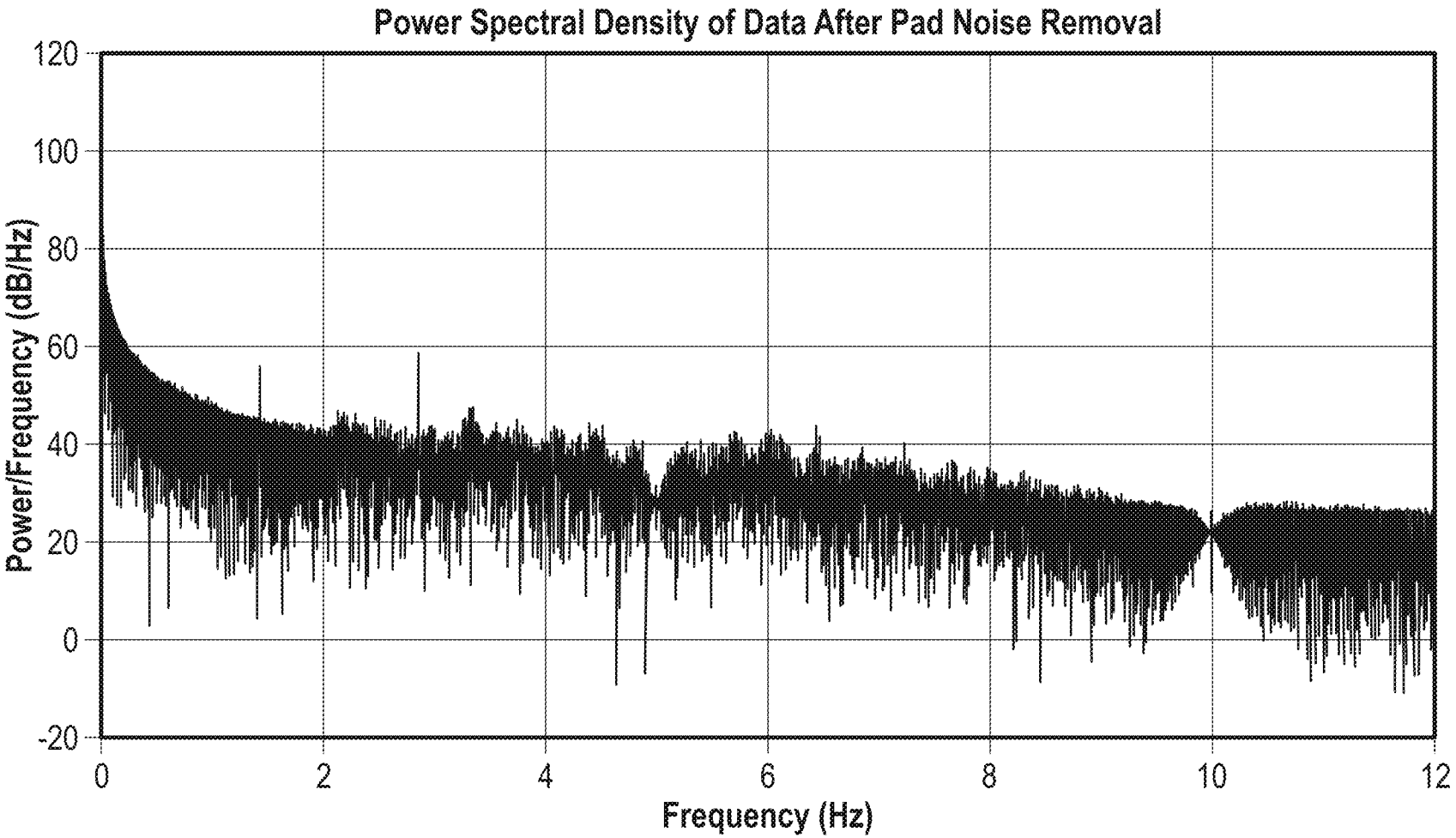

The response of the filter designed with cut-off frequencies equal to the estimated pad frequencies is shown in FIG. 8G. FIGS. 8H and 8I illustrate, respectively, the spectrogram and power spectral density of the filtered data. Comparing FIGS. 8H and 8I, with FIGS. 8C and 8C, it can be inferred that the pad noise frequencies were significantly suppressed after filtering.

Figure 8J:
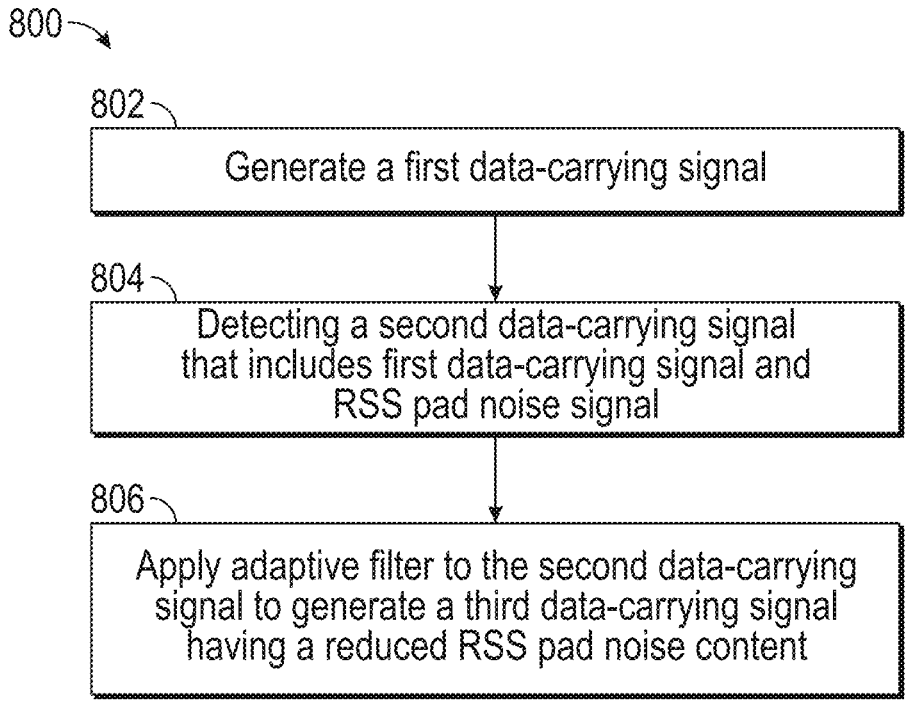
FIG. 8J is a flow chart of a generalized method 800 for a telemetry method to filter RSS pad noise from a data-carrying telemetry signal, according to certain illustrative methods of the present disclosure.

FIG. 8J is a flow chart of a method 800 for a telemetry method to filter RSS pad noise from a data-carrying telemetry signal, according to certain illustrative methods of the present disclosure. With reference also to FIG. 1, at block 802, pulser 104 generates a first data-carrying signal that propagates up wellbore 120 toward pressure sensor 101. At the same time, RSS pads 106*a* or 106*b* are being actuated, thus resulting in an RSS pad noise signal also propagating up though wellbore 120. The first data-carrying signal and RSS pad noise signal combine to form a second data-carrying signal 108 the propagates toward sensor 101. At block 804, the second data-carrying signal is detected by pressure sensor 101. At block 806, controller 110 applies an adaptive filter to the second data-carrying signal in order to filter the RSS pad noise signal. As a result of the filtering, controller 110 generates a third data-carrying signal having a reduced and/or eliminated RSS pad noise content. The third data-carrying signal is then decoded (e.g., demodulated).

The adaptive filtering of block 806 may be performed in a variety of ways. In one illustrative method, controller 110 performs frequency analysis of the second data-carrying signal by identifying the frequency peaks of the RSS noise signal. As previously described, the frequency peaks may be identified by obtaining a spectrum when the RSS pad is not running or running at a low speed (e.g., up to 10 RPM or neutral mode). The controller then applies this as a baseline reference to compare to the data-carrying signal detected when the RSS pad is running. The comparison allows the controller to identify the pad noise frequency. In an alternative method, the controller obtains a spectrum when the pulser is not running, but the RSS pad is actuating. Thus, the detected spectrum includes the RSS pad noise which is identified by the controller. Once identified, the controller then filters the noise frequencies. Once the RSS pad noise frequency has been identified, it is then applied to the second data-carrying signal for filtering, ultimately resulting in the generation of the third data-carrying signal.

In yet another alternative method, controller 110 filters the RSS pad noise signal by first obtaining the RPM of the RSS pad(s). Although not shown, controller 110 communicably coupled to RSS 102 to obtain the RPM of RSS pads 106*a,b*. Using the RPM, controller 110 can then identify the frequency of the RSS pad noise signal as described herein. Once controller 110 identifies the frequency of the RSS pad noise signal, the RSS pad noise signal can then be filtered.

In other illustrative methods, the stopband width of the adaptive filter is optimized to allow for reasonable fluctuation of pad RPM to be filtered out while not filtering out or compromising mud pulse signals.

In certain other illustrative methods, notch filters can be used to adaptively filter out the pad noises before or after the pump noise is filtered. In such an application, for example, after filtering, the detection quality increased from 35% to 87.9% in the case shown in FIGS. 6A-6B and increased from 46.4% to 96% in the case shown in FIGS. 7A-7B.

Figure 9A:
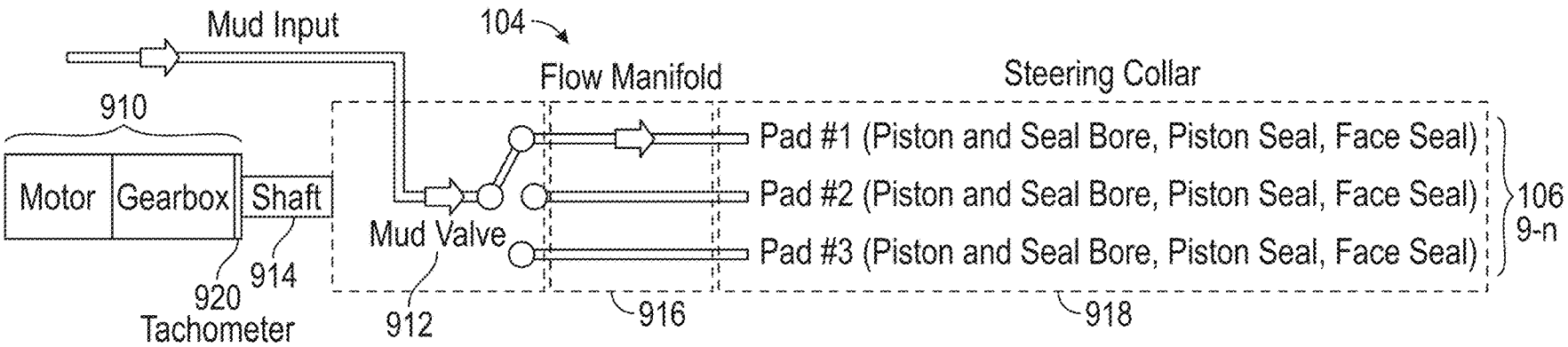
FIG. 9A is a block diagram of an RSS, according to certain illustrative embodiments of the present disclosure.
Figure 9B:
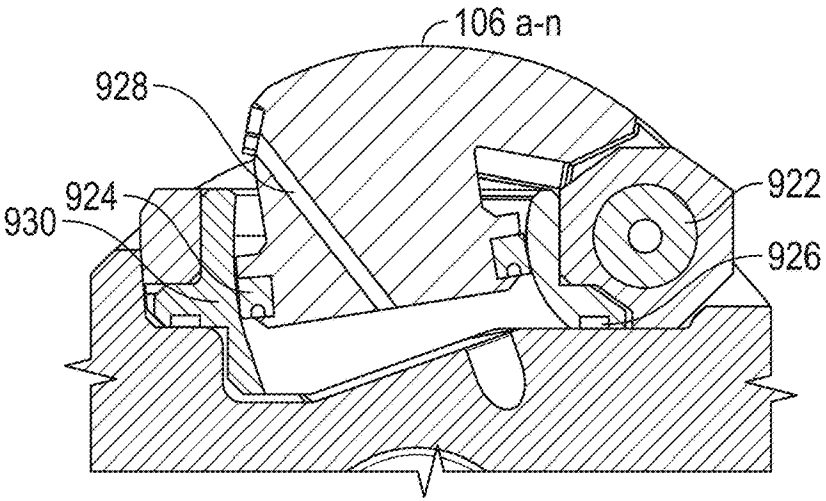
FIG. 9B is an enlarged view of an RSS pad.

As mentioned earlier, illustrative methods of the present disclosure are applied to detect pad seal leaks or other leaks in the RSS 102. FIG. 9A is a block diagram of pulser 104 and FIG. 9B is an enlarged view of an RSS pad and its components, according to an illustrative embodiment of the present disclosure. A motor/gearbox 910 is connected to a mud valve 912 through a shaft 914. When the mud valve 912 is rotated by the motor 910, high pressure mud input is distributed sequentially to three different branches and through a flow manifold 916, which then acts on the piston of each pad 106*a-n* in the steering collar 918. The pads 106*a-n* pivot on a hinge 922 and thus can be pushed open by the high pressure mud acting on the piston. For smooth operation, there is an overlap period when the valve is open to two adjacent pads, i.e. the valve will open to different pads in the following order: pad 1, pad 1+pad2, pad2, pad2+pad3, pad3, pad3+pad1, etc. When the valve opens to a pad 106*a-n*, particularly when the valve opens to two pads at the same time, there will be a noticeable pressure drop caused by the orifices 928 on both pads, and by the displacement of the pistons. This pressure drop will become RSS pad noise to the mud pulse telemetry system, specifically, this noise frequency equals to RPM*3/60.

If the piston seal 924 and/or face seal 926 fails on one of the pads 106*a-n*, when the valve 912 is open to that pad and its adjacent pads, the pressure drop will be even more server, creating a different pad noise (leaky pad noise). The frequency of this noise will be RPM*1/60 if there is only one pad having leaky seals. Therefore, one can derive the pad rotation RPM and presence of leaky pads from this frequency analysis of the mud pressure detected at controller 110.

In addition to the detection of leaky pad face seals 926 or piston seals 924, this illustrative method can also detect any other faulty or leaky components between the motor/gearbox output shaft and the pads 106*a-n*. These leaking components would include, but are not limited to, a broken shaft 914, broken mud valve 912, eroded flow manifold 916, eroded collar mud input line, face seal 926, piston seal 924, seal bore 930 and cracked collar 918. Many of these failures are not detectable from downhole sensors. As shown in FIG. 9A, a tachometer (hall sensor) 920 is mounted at the output side of the gearbox 910, so it is used to detect the gearbox output rotational speed. However, tachometer 920 cannot detect any broken link beyond that. For example, if the shaft 914 breaks, or if the mud valve 912 breaks, the hall sensor 920 cannot detect the breakage and continues to operate as if the valve is rotating at the same speed as the output RPM of the gearbox 910. Also, if the flow manifold 916 or any seals in the mud input line are leaking, the hall sensor 920 would still give the motor RPM, but the pressure measurement from the surface controller will be used to determine if the pad 106*a-n* is being actuation and at what speed (RPM). However, through analysis of noise generated by the RSS 102 using the methods described herein, these leaks can be identified.

Figure 9C:
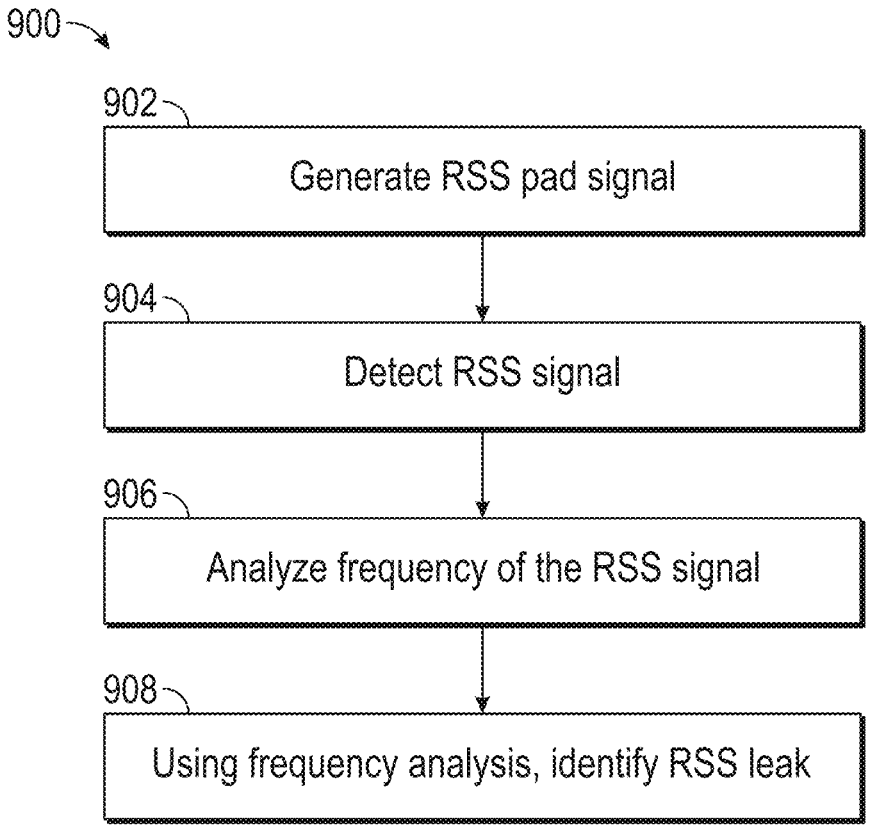
FIG. 9C is a flow chart for a method 900 to detect RSS pad leaks, according to certain illustrative methods of the present disclosure.

FIG. 9C is a flow chart for a method 900 to detect RSS leaks, according to certain illustrative methods of the present disclosure. With reference to FIG. 1 also, at block 902, an RSS signal (e.g., RSS pad noise signal) is generated by pad 106*a* or 106*b*. In certain examples, the RSS signal is detected by sensor 101 while pulser 104 is off. In other examples, the RSS signal combines with a data-carrying signal generated by pulser 104. In the latter case, the RSS signal may be identified using any of the spectrum analysis methods described herein. Nevertheless, at block 904, the RSS pad signal is detected by sensor 101 and identified by controller 110.

At block 906, controller 110 performs frequency analysis of the RSS signal to determine if there is a pad leak or some other RSS component leak. As previously mentioned, when the pad seals are not leaking, the pad noise frequency equals to (single pad actuation RPM)*(number of pads)/60, and its harmonics. When there is a leaky pad, the additional noise created by the leaky pad will have a frequency of (single pad actuation RPM)*1/60, so at 120 RPM, the additional noise spikes are 2 Hz, 4 Hz, 6 Hz, 8 Hz, 10 Hz, . . . etc.). Controller 110 applies this method to identify the frequency spikes in real time, thereby determining whether a leaky pad (or other leaky component) exists at block 908.

In an alternative method, controller 110 may identify RSS pad leaks using surface high speed pressure measurements. As previously mentioned, for example, when there is no leaky seal on the RSS pads, the pad noise frequency equals to [(single pad actuation RPM)*(number of pads)/60]+its harmonics. When the RSS pad's actuation velocity or Geostationary valve rotational speed is 120 RPM, the pad noise frequencies are 6 Hz, 12 Hz, 18 hz, etc. When there is a leaky pad, the additional noise created by the leaky pad will have a frequency of (single pad actuation RPM)*1/60. Therefore, at 120 RPM, the additional noise spikes are 2 Hz, 4 Hz, 6 Hz, 8 Hz, 10 Hz, . . . etc.). Controller 110 detects these spikes in the telemetry signals to detect pad seal leaks in real-time. This method can be performed in real time using pressure pulses, or could be done periodically (after stopping pulser 104) to intentionally run RSS pads at a known RPM, and then perform the analysis to determine if a pad is leaking.

The illustrate embodiments and methods described herein provide a number of advantages. For example, the proposed methods reduce and/or eliminate RSS pad noise and improve mud pulse telemetry signal to noise ratio. In a test case, the detection quality improvement (vs. conventional approach having no RSS pad noise filtration) was 200%. Second, early detection of pad seal leaks allows prompt action to be taken to address steerability and to prevent corrosion damage to expensive parts such as collars, seal bores, pistons, etc.

The filtered telemetry signals described herein may be utilized in a variety of applications, such as to conduct a wellbore operation, perform a drilling operation or adjust a drilling operation.

Embodiments and methods described herein further relate to any one or more of the following paragraphs:

1. A computer-implemented downhole telemetry method, comprising generating a first data-carrying signal which propagates along a wellbore having a drill string therein, wherein the drill string comprises a rotary steerable system ("RSS") having RSS pads that generate an RSS pad noise signal which also propagates along the wellbore; detecting a second data-carrying signal at a controller, the second data-carrying signal being comprised of the first data-carrying signal and the RSS pad noise signal; applying an adaptive filter to the second data-carrying signal in order to filter the RSS pad noise signal and generate a third data-carrying signal having a reduced RSS pad noise content; and outputting the third data-carrying signal.

2. The computer-implemented method as defined in paragraph 1, wherein filtering the RSS pad noise signal comprises performing frequency analysis of the second data-carrying signal; based upon the frequency analysis, identifying frequency peaks of the RSS pad noise signal present within the second data-carrying signal; and filtering the RSS pad noise signal.

3. The computer-implemented method as defined in paragraphs 1 or 2, wherein filtering the RSS pad noise signal comprises obtaining a reference signal which does not include the RSS pad noise signal; comparing the second data-carrying signal to the reference signal; based upon the comparison, identifying the RSS pad noise signal in the second data-carrying signal; and filtering the RSS pad noise signal.

4. The computer-implemented method as defined in any of paragraphs 1-3, wherein filtering the RSS pad noise signal comprises obtaining a reference signal when the RSS is running; comparing the second data-carrying signal to the reference signal; based upon the comparison, identifying the RSS pad noise signal in the second data-carrying signal; and filtering the RSS pad noise signal.

5. The computer-implemented method as defined in any of paragraphs 1-4, wherein the reference signal is obtained when the RSS is running at a speed of up to 10 RPM or neutral.

6. The computer-implemented method as defined in in any of paragraphs 1-5, wherein the first data-carrying signal is generated by a mud pulser positioned along the drill string; and filtering the RSS pad noise signal comprises: obtaining a reference signal while the mud pulser is not running; comparing the second data-carrying signal to the reference signal; based upon the comparison, identifying the RSS pad noise signal in the second data-carrying signal; and filtering the RSS pad noise signal.

7. The computer-implemented method as defined in in any of paragraphs 1-6, wherein filtering the RSS pad noise signal comprises obtaining a revolution per minute ("RMP") of the RSS pads; using the RPM of the RSS pads to identify a frequency of the RSS pad noise signal; and filtering the RSS pad noise signal.

8. The computer-implemented method as defined in in any of paragraphs 1-7, wherein the decoded third data-carrying signal is used to conduct a wellbore operation, perform a drilling operation or adjust a drilling operation.

9. A downhole telemetry system, comprising a drill string comprising a rotary steerable system ("RSS") having RSS pads that generate an RSS pad noise signal which propagates along a wellbore; a telemetry unit which generates a first data-carrying signal that propagates along the wellbore; and a controller which: detects a second data-carrying signal, the second data-carrying signal being comprised of the first data-carrying signal and the RSS pad noise signal; applies an adaptive filter to the second data-carrying signal in order to filter the RSS pad noise signal and generate a third data-carrying signal having a reduced RSS pad noise content; and outputs the third data-carrying signal.

10. The system as defined in paragraph 9, wherein filtering the RSS pad noise signal comprises performing frequency analysis of the second data-carrying signal; based upon the frequency analysis, identifying frequency peaks of the RSS pad noise signal present within the second data-carrying signal; and filtering the RSS pad noise signal.

11. The system as defined in paragraphs 9 or 10, wherein filtering the RSS pad noise signal comprises obtaining a reference signal which does not include the RSS pad noise signal; comparing the second data-carrying signal to the reference signal; based upon the comparison, identifying the RSS pad noise signal in the second data-carrying signal; and filtering the RSS pad noise signal.

12. The system as defined in in any of paragraphs 9-11, wherein filtering the RSS pad noise signal comprises obtaining a reference signal when the RSS is running; comparing the second data-carrying signal to the reference signal; based upon the comparison, identifying the RSS pad noise signal in the second data-carrying signal; and filtering the RSS pad noise signal.

13. The system as defined in in any of paragraphs 9-12, wherein the reference signal is obtained when the RSS is running at a speed of up to 10 RPM or neutral.

14. The system as defined in in any of paragraphs 9-13, wherein the telemetry unit is a mud pulser positioned along the drill string; and filtering the RSS pad noise signal comprises: obtaining a reference signal while the mud pulser is not running; comparing the second data-carrying signal to the reference signal; based upon the comparison, identifying the RSS pad noise signal in the second data-carrying signal; and filtering the RSS pad noise signal.

15. The system as defined in in any of paragraphs 9-14, wherein filtering the RSS pad noise signal comprises obtaining a revolution per minute ("RMP") of the RSS pads; using the RPM of the RSS pads to identify a frequency of the RSS pad noise signal; and filtering the RSS pad noise signal.

16. The system as defined in in any of paragraphs 9-15, wherein the decoded third data-carrying signal is used to conduct a wellbore operation, perform a drilling operation or adjust a drilling operation.

17. A computer-implemented method to detect rotary steerable system ("RSS") leaks, the method comprising generating an RSS signal that propagates along a telemetry system positioned in a wellbore; detecting the RSS signal at a controller; analyzing a frequency of the RSS signal; and based upon the frequency analysis, identifying a RSS leak.

18. The computer-implemented method as defined in paragraph 17, wherein the RSS leak is a leak in an RSS pad, shaft, valve, flow manifold, mud input line, face seal, piston seal, seal bore or steering collar.

19. The computer-implemented method as defined in paragraphs 17 or 18, wherein analyzing the frequency of the RSS pad signal comprises obtaining a reference signal from a non-leaking RSS pad; and comparing the frequency of the RSS pad signal to a frequency of the reference signal.

20. The computer-implemented method as defined in any of paragraphs 17-19, wherein analyzing the frequency of the RSS signal comprises identifying spectrum peaks.

Furthermore, any of the illustrative methods described herein may be implemented by a system comprising processing circuitry or a non-transitory computer readable medium comprising instructions which, when executed by at least one processor, causes the processor to perform any of the methods described herein.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A computer-implemented telemetry method, comprising:

generating a first data-carrying signal which propagates along a wellbore having a drill string therein, wherein the drill string comprises a rotary steerable system ("RSS") having RSS pads that generate an RSS pad noise signal which also propagates along the wellbore;

identifying a rotational speed of the RSS;

identifying a frequency of the RSS pad noise signal from the rotational speed of the RSS pads;

detecting a second data-carrying signal at a surface computer, the second data-carrying signal being comprised of the first data-carrying signal and the RSS pad noise signal; and applying an adaptive filter to the second data-carrying signal at the surface computer after the RSS pad noise signal contributes in forming the second data-carrying signal, wherein the adaptive filter is applied in order to:

filter the RSS pad noise signal from the second data-carrying signal, and generate a third data-carrying signal having a reduced RSS pad noise content.

2. The computer-implemented method as defined in claim 1, wherein the application of the adaptive filter includes:

performing a frequency analysis of the second data-carrying signal; and identifying frequency peaks of the RSS pad noise signal present within the second data-carrying signal based on the frequency analysis.

3. The computer-implemented method as defined in claim 1, wherein the application of the adaptive filter includes:

obtaining a reference signal which does not include the RSS pad noise signal;

comparing the second data-carrying signal to the reference signal; and identifying the RSS pad noise signal in the second data-carrying signal based on the comparison.

4. The computer-implemented method as defined in claim 1, wherein the application of the adaptive filter includes:

obtaining a reference signal when the RSS is running;

comparing the second data-carrying signal to the reference signal;

identifying the RSS pad noise signal in the second data-carrying signal based on the comparison.

5. The computer-implemented method as defined in claim 4, wherein the reference signal is obtained when the RSS is running at a speed of up to 10 RPM or neutral.

6. The computer-implemented method as defined in claim 1, wherein:

the first data-carrying signal is generated by a mud pulser positioned along the drill string; and application of the adaptive filter includes:

obtaining a reference signal while the mud pulser is not running;

comparing the second data-carrying signal to the reference signal;

identifying the RSS pad noise signal in the second data-carrying signal based on the comparison.

7. The computer-implemented method as defined in claim 1, further comprising:

decoding data from the third data-carrying signal; and initiating an adjustment to at least one of a wellbore operation or a drilling operation is performed in response to the decoded data.

8. A telemetry system, comprising:

a drill string comprising a rotary steerable system ("RSS") having RSS pads that generate an RSS pad noise signal which propagates along a wellbore;

a telemetry unit which generates a first data-carrying signal that propagates along the wellbore; and a surface computer that:

identifies a rotational speed of the RSS, identifies a frequency of the RSS pad noise signal from the rotational speed of the RSS pads;

detects a second data-carrying signal, the second data-carrying signal being comprised of the first data-carrying signal and the RSS pad noise signal; and applies an adaptive filter to the second data-carrying signal, at the surface computer after the RSS pad noise signal contributes in forming the second data-carrying signal, wherein the adaptive filter is applied in order to:

filter the RSS pad noise signal, and generate a third data-carrying signal having a reduced RSS pad noise content.

9. The system as defined in claim 8, wherein the application of the digital filter also includes:

performing frequency analysis of the second data-carrying signal;

identifying frequency peaks of the RSS pad noise signal present within the second data-carrying signal based on the frequency analysis.

10. The system as defined in claim 8, wherein the application of the digital filter also includes:

obtaining a reference signal which does not include the RSS pad noise signal;

comparing the second data-carrying signal to the reference signal;

based upon the comparison, identifying the RSS pad noise signal in the second data-carrying signal, based on the comparison.

11. The system as defined in claim 8, wherein the application of the adaptive filter includes:

obtaining a reference signal when the RSS is running;

comparing the second data-carrying signal to the reference signal;

identifying the RSS pad noise signal in the second data-carrying signal based on the comparison.

12. The system as defined in claim 11, wherein the reference signal is obtained when the RSS is running at a speed of up to 10 RPM or neutral.

13. The system as defined in claim 8, wherein:

the telemetry unit is a mud pulser positioned along the drill string; and the application of the adaptive filter also includes:

obtaining a reference signal while the mud pulser is not running;

comparing the second data-carrying signal to the reference signal;

identifying the RSS pad noise signal in the second data-carrying signal based on the comparison.

14. The system as defined in claim 8, wherein data is decoded from third data-carrying signal and an adjustment to al lest one of a wellbore operation a drilling operation is performed in response to the decoded data.

* * * * *